US010814632B2

(12) United States Patent
Fukunaga et al.

(10) Patent No.: US 10,814,632 B2
(45) Date of Patent: Oct. 27, 2020

(54) CAP MEMBER AND INK-JET RECORDING APPARATUS INCLUDING SAME

(71) Applicant: KYOCERA Document Solutions Inc., Osaka (JP)

(72) Inventors: Yasuyuki Fukunaga, Osaka (JP); Masaki Murashima, Osaka (JP); Satoshi Ishii, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/298,429

(22) Filed: Mar. 11, 2019

(65) Prior Publication Data

US 2019/0291440 A1 Sep. 26, 2019

(30) Foreign Application Priority Data

Mar. 22, 2018 (JP) ..... 2018-054873
Mar. 22, 2018 (JP) ..... 2018-054879

(51) Int. Cl.
*B41J 2/165* (2006.01)

(52) U.S. Cl.
CPC ..... *B41J 2/16505* (2013.01); *B41J 2/16508* (2013.01)

(58) Field of Classification Search
CPC ..... B41J 2/16505; B41J 2/16508; B41J 2/16538; B41J 2/16547; B41J 2/16511; B41J 2/16585; B41J 2/01; B41J 2/16535
See application file for complete search history.

(56) References Cited

U.S. PATENT DOCUMENTS 6,068,364 A 5/2000 Kusumi et al. ..... 347/29
6,203,136 B1 * 3/2001 Takahashi ..... B41J 2/16508 347/29
2014/0210903 A1 7/2014 Tanda ..... 347/29

FOREIGN PATENT DOCUMENTS

CN 103963457 A 8/2014
JP 10-146986 A 6/1998
JP 2014-144585 A 8/2014

OTHER PUBLICATIONS

Chinese Office Action dated Jun. 16, 2020 issued by the National Intellectual Property Administration in corresponding application CN 201910192343.5.

* cited by examiner

*Primary Examiner* — Justin Seo
(74) *Attorney, Agent, or Firm* — Stein IP, LLC

(57) ABSTRACT

A cap member includes a cap portion and a support member. The cap portion has a bottom surface portion and a side surface portion. The support member supports the bottom surface portion of the cap member. The bottom surface portion is provided with a groove portion defined by a first rib projecting from an upper surface of the bottom surface portion. A lid member which covers the groove portion is provided on, and in close contact with. an upper end of the first rib. The groove portion and the lid member define an air passage through which air passes. One end portion of the air passage communicates with an inner space of the cap member, and the other end portion of the air passage communicates with an outside of the cap portion.

14 Claims, 19 Drawing Sheets

CAP MEMBER AND INK-JET RECORDING APPARATUS INCLUDING SAME

INCORPORATION BY REFERENCE

This application is based upon and claims the benefit of priority from the corresponding Japanese Patent Application No. 2018-054879 filed on Mar. 22, 2018 and Japanese Patent Application No. 2018-054873 filed on Mar. 22, 2018, the entire contents of both of which are incorporated herein by reference.

BACKGROUND

The present disclosure relates to a cap member which caps an ink ejection surface of a recording head which ejects ink onto a recording medium such as a paper sheet, and to an inkjet recording apparatus including the same.

Inkjet recording apparatuses that eject ink and form an image with the ink are capable of forming a high-definition image and thus have been widely used as recording apparatuses such as facsimile machines, copiers, and printers.

Conventionally, in an inkjet recording apparatus, in order to prevent drying and clogging of an ink ejection port of a recording head, typically, the recording head is kept capped in a case where printing is not scheduled to be performed for a long period of time. For this purpose, an inkjet recording apparatus is provided with a recording head which ejects ink onto a recording medium, and a cap unit having a cap portion which caps an ink ejection surface of the recording head. To prevent drying and clogging of an ink ejection port, the cap portion has high sealability.

In an inkjet recording apparatus, an air-ink interface (ink surface) at an ink ejection port is slightly dented due to surface tension to form a meniscus. A meniscus is broken even with a very low pressure, and if a meniscus is broken, the ejection of ink becomes unstable.

When the cap portion is brought into pressure contact with an ink ejection surface (capping) or when the cap portion is moved away from an ink ejection surface, if the air pressure inside the cap portion changes, the meniscus can be broken.

To prevent this, an inkjet recording apparatus has been proposed which is provided with an air communication passage which allows communication between an inner space of a cap portion and an outside of the cap portion. Known as an example of such an inkjet recording apparatus is one that is provided with a cap portion which is made of rubber or the like and which caps an ink ejection surface of a recording head, and a tube which allows communication between an inner space of the cap portion and an outside of the cap portion. The cap portion has an air vent formed therein, and one end of the tube is connected to the air vent.

In this inkjet recording apparatus, the inner space of the cap portion communicates with the outside of the cap portion. With this configuration, it is possible to moderate the variation in air pressure in the inner space of the cap portion caused when the cap portion is brought into pressure contact with the ink ejection surface (capping) or moved away from the ink ejection surface, and thus to reduce breakage of a meniscus.

SUMMARY

According to a first aspect of the present disclosure, a cap member caps an ink ejection surface of a recording head, the ink ejection surface having an ink ejection port formed therein. The cap member includes a cap portion and a support member which is made of sheet metal. The cap portion is an elastic body having a bottom surface portion and a side surface portion which is ring-shaped, stands on the bottom surface portion, and contacts the ink ejection surface. The support member supports a lower surface of the bottom surface portion of the cap portion. The bottom surface portion of the cap portion is provided with a groove portion which is defined by a first rib projecting from an upper surface of the bottom surface portion. A lid member which covers the groove portion is provided on, and in close contact with, an upper end of the first rib. The groove portion and the lid member define an air passage through which air passes. One end portion of the air passage communicates with an inner space of the cap portion, and the other end portion of the air passage communicates with an outside of the cap portion.

Still other objects of the present disclosure and specific advantages provided by the present disclosure will become further apparent from the following descriptions of embodiments.

DETAILED DESCRIPTION

Hereinafter, embodiments of the present disclosure will be described with reference to the accompanying drawings.

First Embodiment

Figure 1:
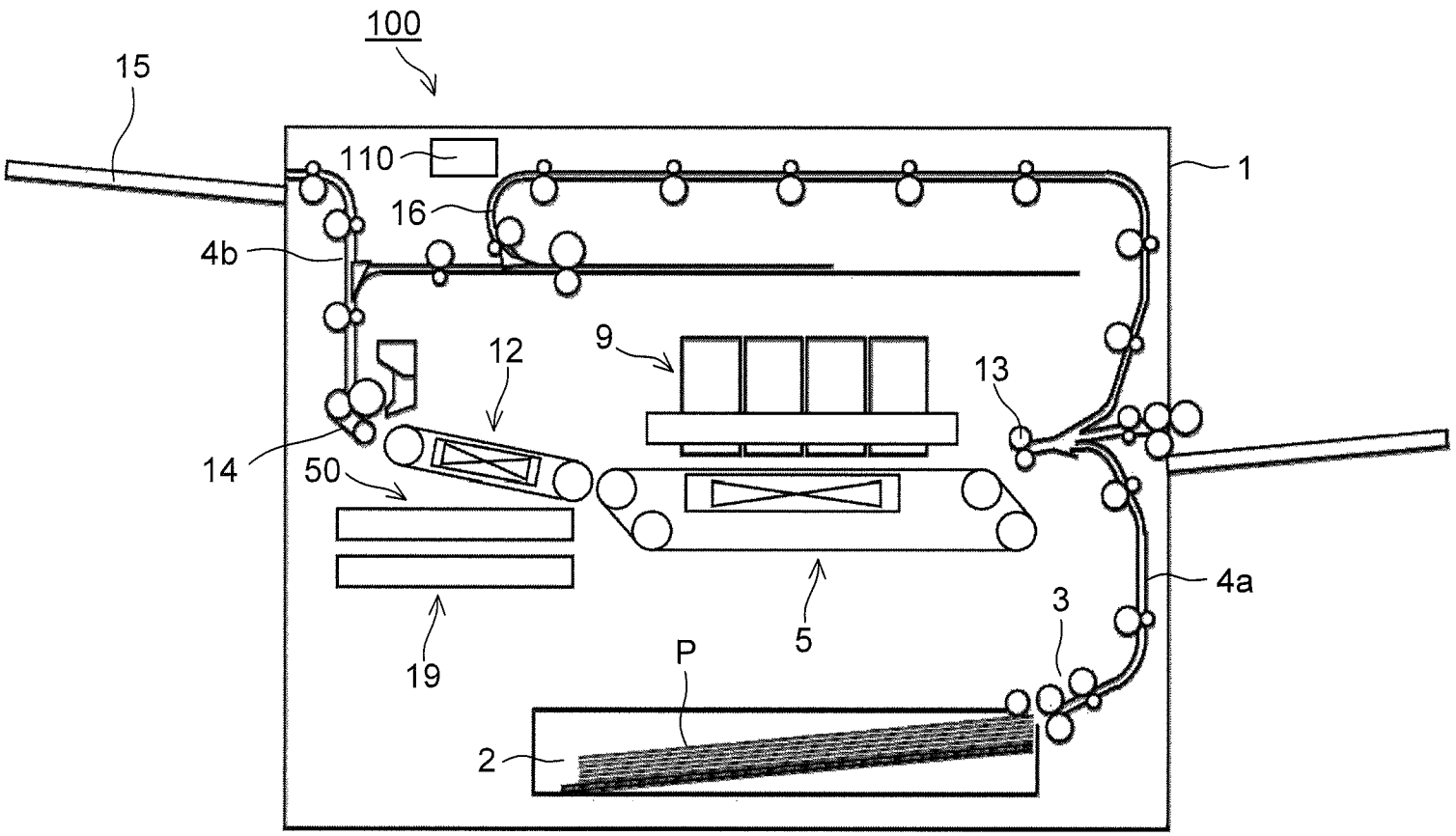
FIG. 1 is a diagram illustrating a schematic structure of a printer provided with a cap member according to a first embodiment of the present disclosure.

With reference to FIG. 1 to FIG. 34, a description will be given of an inkjet-type printer 100 (an inkjet recording apparatus) provided with a cap member 140 according to a first embodiment of the present disclosure. As illustrated in FIG. 1, the printer 100 has a sheet feeding cassette 2 which is a sheet container and disposed in a lower part inside a printer main body 1. The sheet feeding cassette 2 holds therein paper sheets P as an example of a recording medium. On a downstream side of the sheet feeding cassette 2 in a sheet conveyance direction, that is, on an upper right side of the sheet feeding cassette 2 in FIG. 1, a sheet feeding device 3 is disposed. By the sheet feeding device 3, the paper sheets P are fed out one by one separately toward the upper right side of the sheet feeding cassette 2 in FIG. 1.

The printer 100 further includes a first sheet conveyance path **4*a* disposed inside thereof. The first sheet conveyance path 4*a* is located on the upper right side with respect to the sheet feeding cassette 2, toward which a paper sheet is fed out of the sheet feeding cassette 2. The paper sheet P fed out of the sheet feeding cassette 2 is conveyed vertically upward along a side surface of the printer main body 1 via the first sheet conveyance path 4*a***.

At a downstream end of the first sheet conveyance path **4*a* with respect to the sheet conveyance direction, a registration roller pair 13 is provided. Furthermore, a first conveyance unit 5 and a recording portion 9 are disposed immediately close to the registration roller pair 13 on a downstream side of the registration roller pair 13 in the sheet conveyance direction. The paper sheet P fed out of the sheet feeding cassette 2 passes through the first sheet conveyance path 4*a* to reach the registration roller pair 13. While correcting oblique feeding of the paper sheet P, the registration roller pair 13 feeds out the paper sheet P toward the first conveyance unit 5, with timing coordinated with an ink ejecting operation performed by the recording portion 9**.

On a downstream side of the first conveyance unit 5 with respect to the sheet conveyance direction (a left side in FIG. 1), a second conveyance unit 12 is disposed. The paper sheet P on which an ink image has been recorded at the recording portion 9 is sent to the second conveyance unit 12, and while the paper sheet P passes through the second conveyance unit 12, ink that has been ejected onto a surface of the paper sheet P is dried.

A de-curler portion 14 is provided at a position that is on a downstream side of the second conveyance unit 12 with respect to the sheet conveyance direction and that is near a left side surface of the printer main body 1. The paper sheet P on which the ink has been dried at the second conveyance unit 12 is sent to the de-curler portion 14, where a curl generated in the paper sheet P is corrected.

A second sheet conveyance path **4*b* is provided on a downstream side of the de-curler portion 14 with respect to the sheet conveyance direction (an upper side in FIG. 1). In a case where no double-sided recording is to be performed, the paper sheet P that has passed through the de-curler portion 14 is discharged from the second sheet conveyance path 4***b* onto a sheet discharge tray 15, which is provided outside the left side surface of the printer 100.

At a position that is in an upper portion of the printer main body 1 and that is above the recording portion 9 and the second conveyance unit 12, there is provided a reverse conveyance path 16 for double-sided recording. In a case where double-sided recording is to be performed, the paper sheet P on which recording with respect to a first surface thereof has been completed and that has passed through the second conveyance unit 12 and the de-curler portion 14 is sent to the reverse conveyance path 16 via the second sheet conveyance path 4*b*. A conveyance direction of the paper sheet P thus sent to the reverse conveyance path 16 is switched for recording to be performed on a second surface thereof, and the paper sheet P is sent rightward by passing through the upper portion of the printer main body 1; then, via the first sheet conveyance path 4*a* and the registration roller pair 13, with the second surface facing upward, the paper sheet P is sent again to the first conveyance unit 5.

Below the second conveyance unit 12, a wipe unit 19 and a cap unit 50 are disposed When later-described purge is performed, the wipe unit 19 horizontally moves to below the recording portion 9, where the wipe unit 19 wipes off ink extruded through an ink ejection port of the recording head, and collects the wiped-off ink. For capping an ink ejection surface of the recording head, the cap unit 50 horizontally moves to below the recording portion 9, and further moves upward to be mounted on a lower surface of the recording head.

Figure 2:
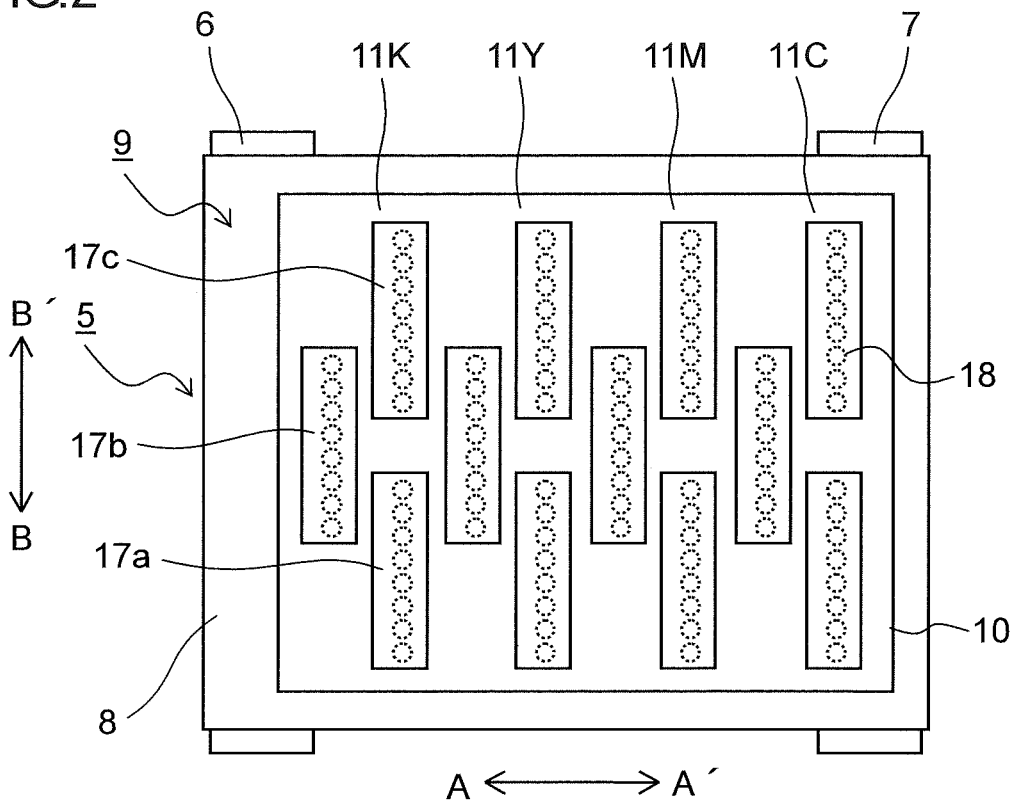
FIG. 2 is a diagram illustrating a first conveyance unit and a recording portion of the printer according to the first embodiment of the present disclosure as seen from above.
Figure 3:
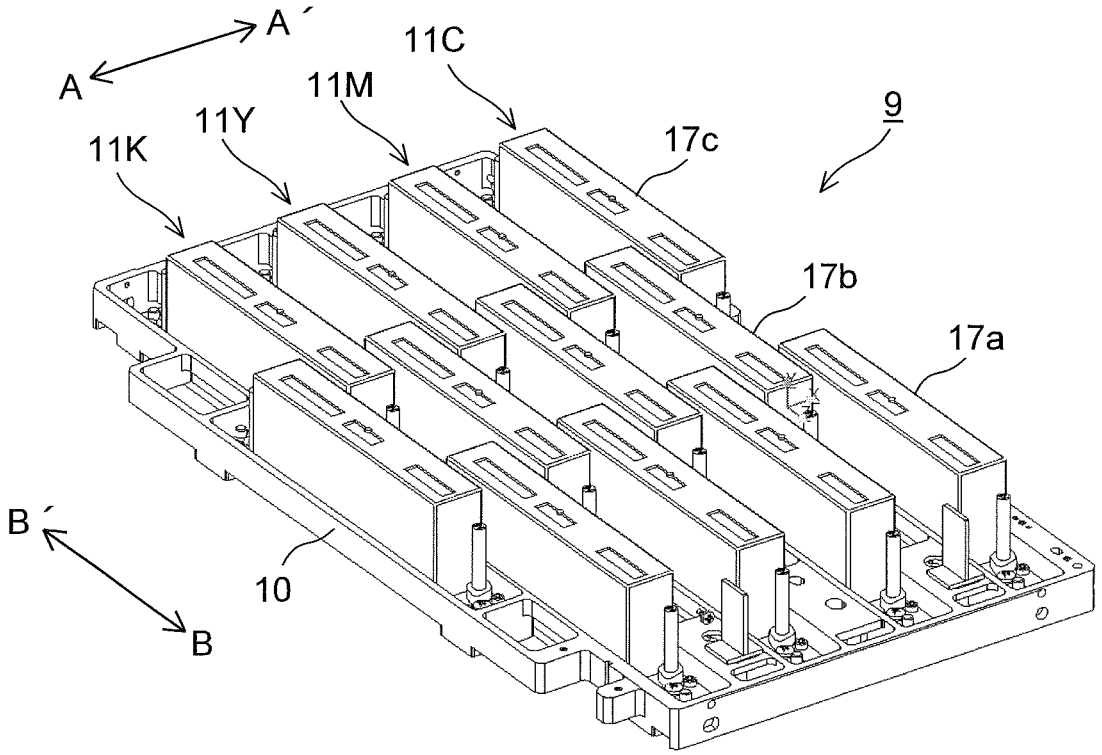
FIG. 3 is a diagram illustrating a structure of the recording portion of the printer according to the first embodiment of the present disclosure.

As illustrated in FIG. 2 and FIG. 3, the recording portion 9 is provided with a head housing 10 and line heads 11C, 11M, 11Y, and 11K held in the head housing 10. The line heads 11C to 11K are supported at a height such that a predetermined interval (for example, 1 mm) is formed with respect to a conveyance surface of a first conveyance belt 8 that is stretched over a plurality of rollers including a driving roller 6 and a driven roller 7; each of the line heads 11C to 11K is formed by arranging a plurality of (herein, three) recording heads 17*a* to 17*c* in a staggered manner along a sheet width direction (an arrow-BB' direction), which is orthogonal to the sheet conveyance direction (an arrow-A direction).

Figure 4:
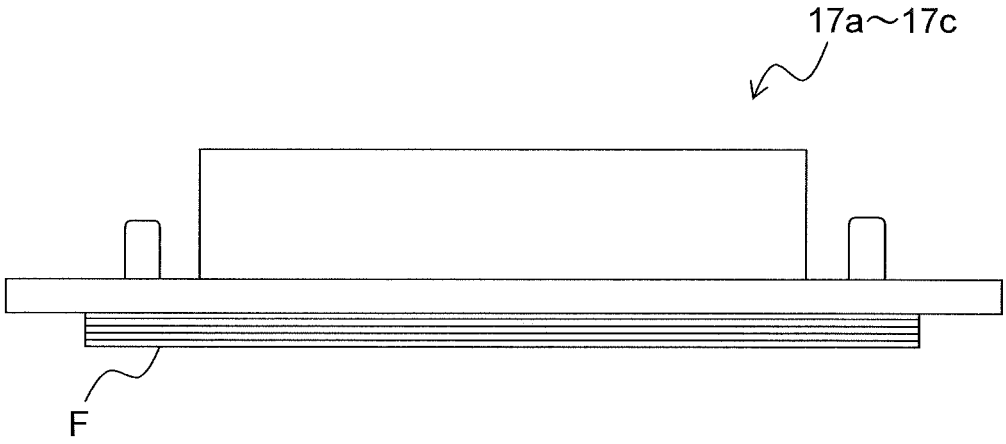
FIG. 4 is a diagram illustrating a structure of a recording head in a line head of the recording portion of the printer according to the first embodiment of the present disclosure.
Figure 5:
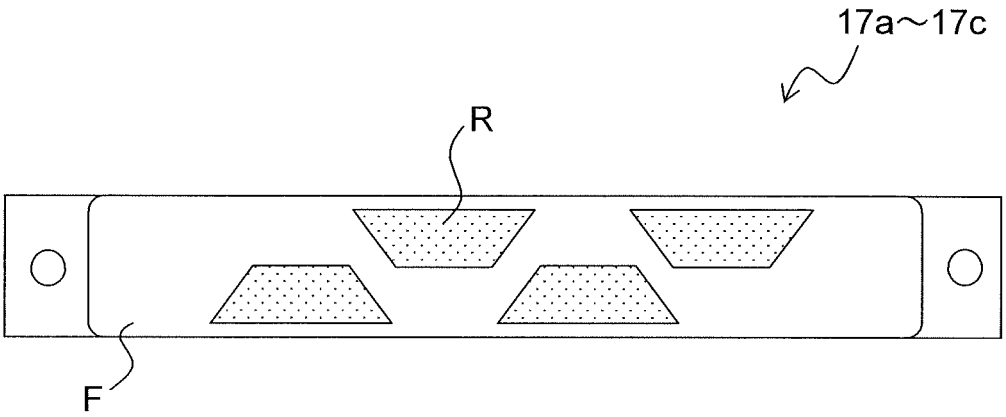
FIG. 5 is a diagram illustrating the recording head of the printer according to the first embodiment of the present disclosure as seen from the side of an ink ejection surface.

As illustrated in FIG. 4 and FIG. 5, on an ink ejection surface F of each of the recording heads 17*a* to 17*c*, there is provided an ink ejection region R in which a large number of ink ejection ports 18 (see FIG. 2) are arranged. The recording heads 17*a* to 17*c* are identical in shape and configuration, and thus, FIG. 4 and FIG. 5 show one recording head representing the recording heads 17*a* to 17*c*.

Figure 6:
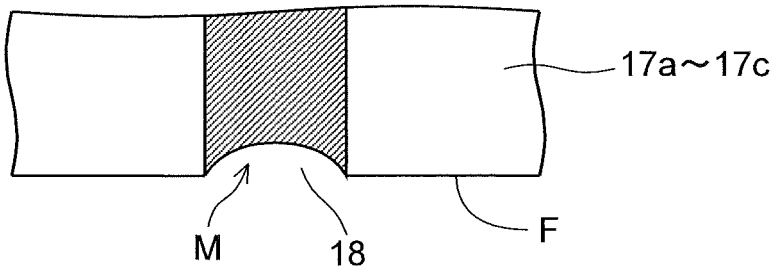
FIG. 6 is a diagram illustrating a meniscus formed at an ink ejection port of the recording head of the printer according to the first embodiment of the present disclosure.

As illustrated in FIG. 6, in each ink ejection port 18 of each of the recording heads 17*a* to 17*c*, ink (indicated with hatching in FIG. 6) forms a meniscus M that is curved toward an inside of each of the recording heads 17*a* to 17*c*.

The recording heads 17*a* to 17*c* constituting each of the line heads 11C to 11K are supplied with ink of one of four colors (cyan, magenta, yellow, and black) stored in ink tanks (not shown), respectively, corresponding to respective colors of the line heads 11C to 11K.

Based on a control signal from a control portion 110 (see FIG. 1) which controls the printer 100 as a whole, each of the recording heads 17*a* to 17*c* ejects ink through the ink ejection ports 18, in accordance with image data received from an external computer or the like, toward the paper sheet P conveyed while being held by suction on the conveyance surface of the first conveyance belt 8. Thereby, on the paper sheet P held on the first conveyance belt 8, ink images of the four colors of cyan, magenta, yellow, and black are superimposed on each other to form a color image.

In the printer 100, in order to clean the ink ejection surfaces F of the recording heads 17*a* to 17*c*, at a start of printing after a long-term shutdown or in an interval between printing operations, ink is forcibly extruded from all of the recording heads 17*a* to 17*c* through the ink ejection ports 18, and the ink ejection surfaces F are wiped with later-described wipers 35*a* to 35*c*, and thus the printer 100 is made ready for a next printing operation.

Next, a detailed description will be given of structures of, and around, the cap unit 50 and the wipe unit 19.

Figure 7:
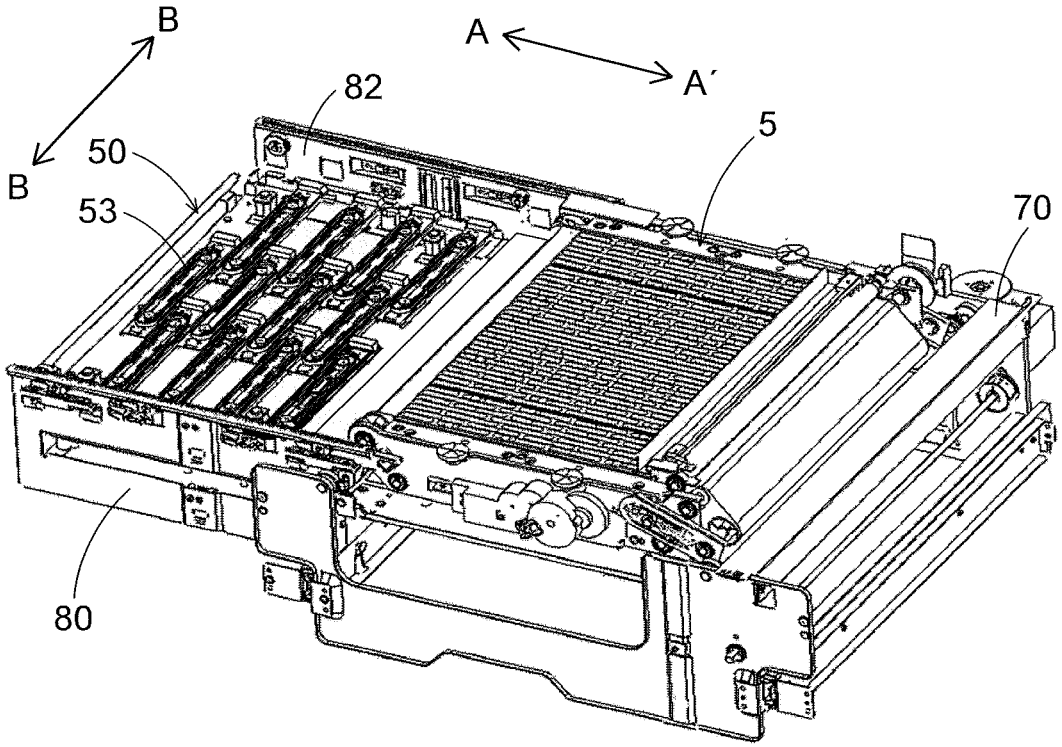
FIG. 7 is a diagram illustrating structures of a cap unit, the first conveyance unit, and so forth of the printer according to the first embodiment of the present disclosure, with the first conveyance unit disposed at a raised position.
Figure 8:
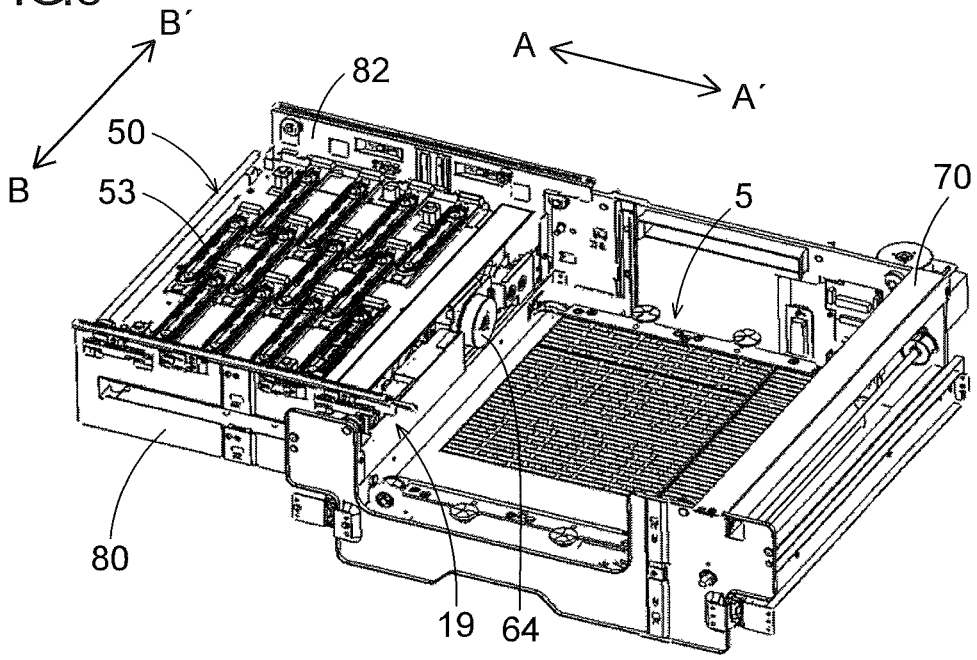
FIG. 8 is a diagram illustrating structures of the cap unit, the first conveyance unit, and so forth of the printer according to the first embodiment of the present disclosure, with the first conveyance unit disposed at a lowered position.

As illustrated in FIG. 7 and FIG. 8, the first conveyance unit 5 is housed in a housing frame 70. The first conveyance unit 5 is configured to be ascendible/descendible in an up-down direction by a conveyance ascending/descending mechanism (not shown) composed of an ascending/descending drive source, a gear train, etc. During a printing operation, the first conveyance unit 5 is disposed at a raised position (the position in FIG. 7) and is close to the ink ejection surfaces F of the recording heads 17*a* to 17*c*. During a recovery operation and a capping operation, which will be described later, performed with respect to the recording heads 17*a* to 17*c*, the first conveyance unit 5 is disposed at a lowered position (a position as illustrated in FIG. 8).

Figure 9:
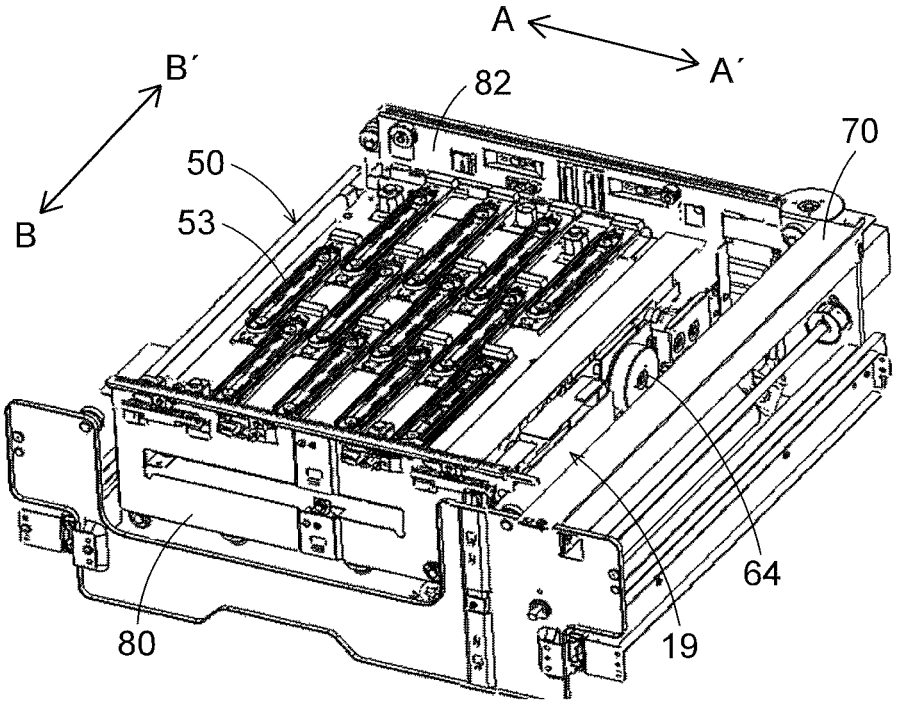
FIG. 9 is a diagram illustrating structures of the cap unit and so forth of the printer according to the first embodiment of the present disclosure, with the cap unit and a wipe unit disposed at a first position.
Figure 10:
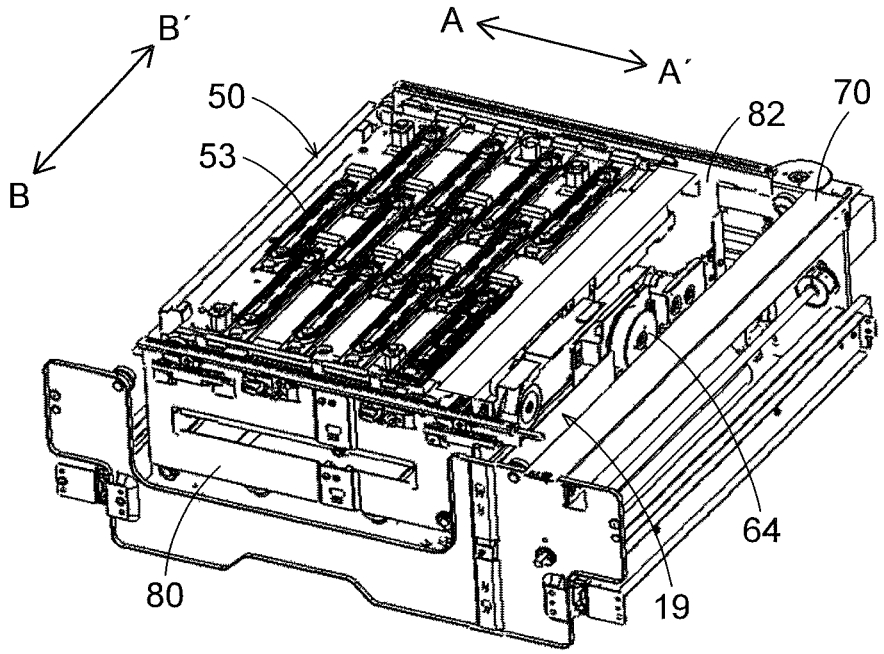
FIG. 10 is a diagram illustrating a state after the cap unit and the wipe unit are raised from the state illustrated in FIG. 9.

As illustrated in FIG. 8 and FIG. 9, the cap unit 50 is configured to be able to reciprocate between a first position (the position in FIG. 9) directly below the recording portion 9 and a second position (the position in FIG. 8) retracted in a horizontal direction (the arrow A direction) from the first position. When the cap unit 50 is disposed at the first position, the first conveyance unit 5 is disposed at the lowered position. As illustrated in FIG. 9 and FIG. 10, the cap unit 50 is configured to be ascendible/descendible in the up-down direction when at the first position.

During a printing operation and during a recovery operation, the cap unit 50 is disposed at the second position (the position in FIG. 7). The cap unit 50 is configured to cap the recording heads 17*a* to 17*c* during a capping operation by moving upward at the first position (the position in FIG. 9 and in FIG. 10). As will be described later, the cap unit 50 is configured to be connectable and disconnectable to and from the wipe unit 19 when at the second position. Movements of the cap unit 50 in the horizontal direction and in the up-down direction is performed with the wipe unit 19 connected to the cap unit 50.

Figure 11:
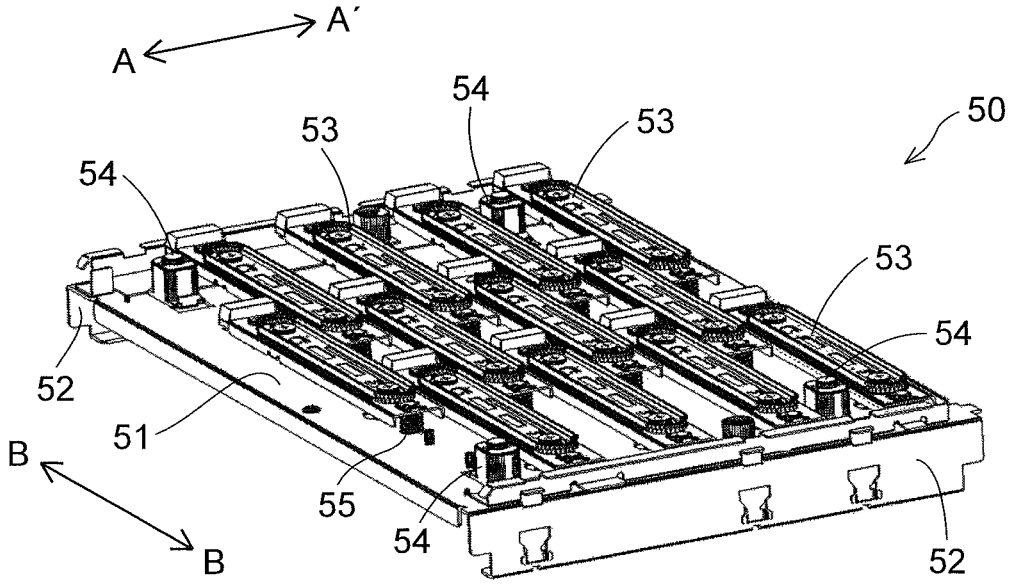
FIG. 11 is a diagram illustrating a structure of the cap unit of the printer according to the first embodiment of the present disclosure.

As illustrated in FIG. 11, the cap unit 50 includes a cap tray 51 which is made of sheet metal, a pair of tray side plates 52 which are formed one at each of opposite ends of the cap tray 51 in the sheet width direction (the arrow-BB' direction), twelve cap portions 53 that are concave and disposed on an upper surface of the cap tray 51, and four height-direction positioning protrusions 54. A description will be given later of a detailed structure of the cap member 140 (see FIG. 18) having the cap portions 53.

The cap portions 53 are disposed at positions corresponding to the recording heads 17*a* to 17*c*. With this configuration, as illustrated in FIG. 10, the cap unit 50 moves upward at the first position, and thereby, each of the cap portions 53 caps the ink ejection surface F of a corresponding one of the recording heads 17*a* to 17*c*. When the cap unit 50 is caused to ascend to the recording portion 9 side so as to cap the recording heads 17*a* to 17*c*, the height-direction positioning protrusions 54 come into contact with the head housing 10 of the recording portion 9, and thereby performs positioning of the cap tray 51 in a height direction. At each of opposite ends of the cap portions 53 in a longitudinal direction thereof (the arrow-BB' direction), a cap spring 55 which is a compression spring is disposed between a lower portion of the cap portion 53 and the cap tray 51. The cap spring 55 helps maintain a constant contact state between the cap portions 53 and the ink ejection surfaces F.

Figure 12:
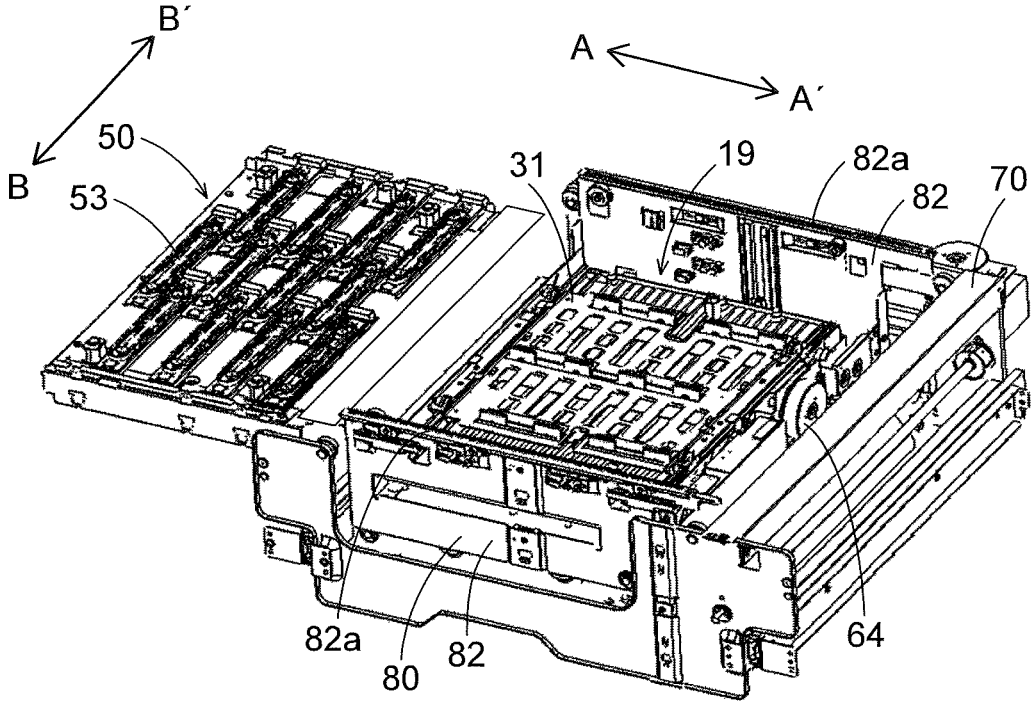
FIG. 12 is a diagram illustrating structures of the cap unit, the wipe unit, and so forth of the printer according to the first embodiment of the present disclosure, with the cap unit disposed at a second position, with the wipe unit disposed at the first position.
Figure 13:
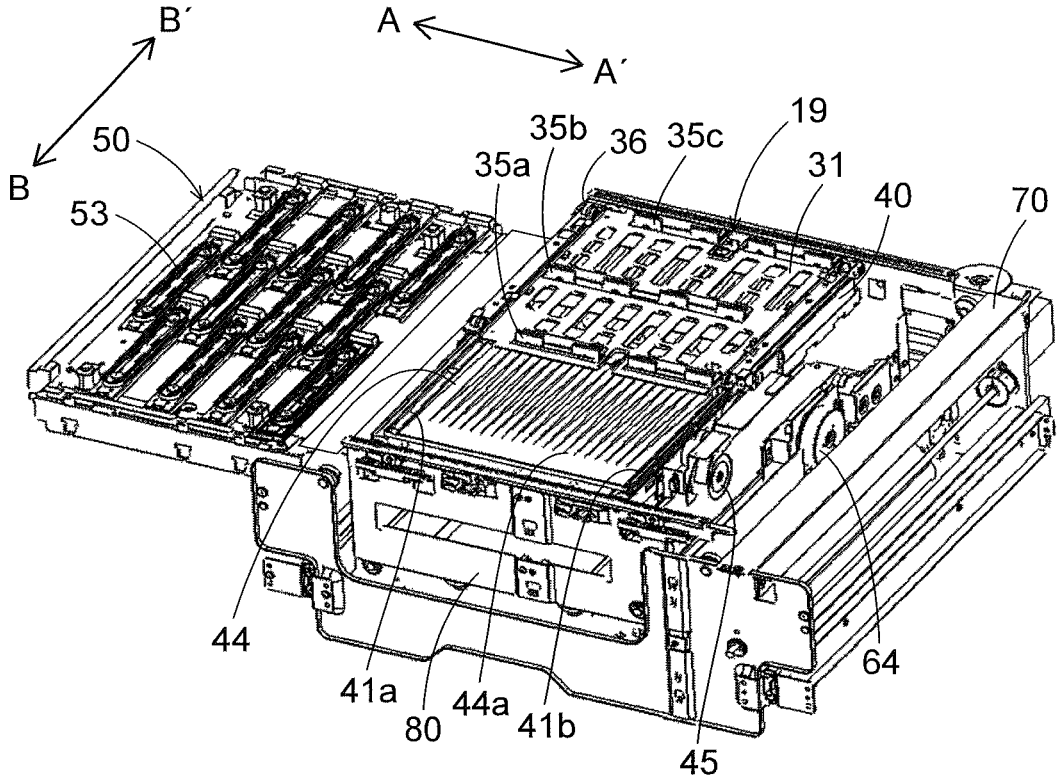
FIG. 13 is a diagram illustrating a state after the wipe unit is raised from the state illustrated in FIG. 12.

As illustrated in FIG. 8 and FIG. 12, the wipe unit 19 is configured to be able to reciprocate between a first position (the position in FIG. 12) directly below the recording portion 9 and a second position (the position in FIG. 8) retracted in the horizontal direction (the arrow-A direction) from the first position. When the wipe unit 19 is disposed at the first position, the first conveyance unit 5 is disposed at the lowered position. As illustrated in FIG. 12 and FIG. 13, the wipe unit 19 is configured to be ascendible/descendible in the up-down direction when at the first position.

During a printing operation, the wipe unit 19 is disposed at the second position. The wipe unit 19 is configured to move upward at the first position (the position in FIG. 12) during a recovery operation and during a capping operation.

Figure 14:
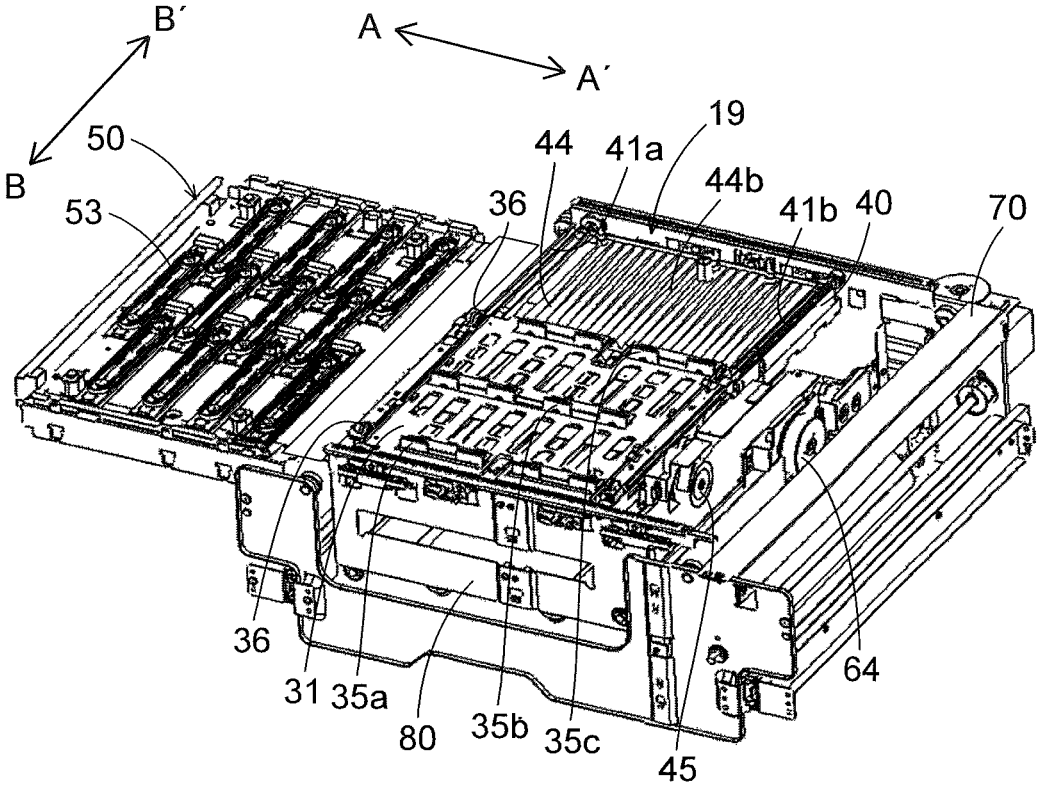
FIG. 14 is a diagram illustrating a state after a wiper carriage is moved in an arrow-B direction from the state illustrated in FIG. 13.

As illustrated in FIG. 13 and FIG. 14, the wipe unit 19 is composed of a substantially rectangular wiper carriage 31, to which a plurality of wipers 35*a* to 35*c* are fixed, and a support frame 40 which supports the wiper carriage 31.

The support frame 40 has rail portions 41*a* and 41*b* formed at opposite edges of an upper surface thereof in the arrow-AA' direction; rollers 36 provided one at each of four corners of the wiper carriage 31 come into contact with the rail portions 41*a* and 41*b*, and thereby the wiper carriage 31 is supported to be slidable in the arrow-BB' direction with respect to the support frame 40.

Fitted to an outside of the support frame 40 are a wiper carriage movement motor 45 for moving the wiper carriage 31 in the horizontal direction (the arrow-BB' direction) and a gear train (not shown) which is engaged with the wiper carriage movement motor 45 and rack teeth (not shown) of the wiper carriage 31. The wiper carriage movement motor 45 rotates forward/reverse, thereby causing the gear train to rotate forward/reverse, such that the wiper carriage 31 reciprocates in the horizontal direction (the arrow-BB' direction).

The wipers 35*a* to 35*c* are each an elastic member (a rubber member made of EPDM, for example) for wiping off ink extruded through the ink ejection ports 18 of each of the recording heads 17*a* to 17*c*. The wipers 35*a* to 35*c* are, from a substantially perpendicular direction, brought into pressure contact with the ink ejection surfaces F of the recording heads 17*a* to 17*c* at wiping start positions outside the ink ejection regions R (see FIG. 5) where the ink ejection ports 18 are formed, and the wipers 35*a* to 35*c* wipe the ink ejection surfaces F including the ink ejection regions R in a predetermined direction (an arrow-B direction in FIG. 13) as the wiper carriage 31 moves.

Four wipers 35*a* are arranged at substantially regular intervals, and similarly, four wipers 35*b* and four wipers 35*c* are also arranged respectively at substantially regular intervals. The wipers 35*a* and the wipers 35*c* are disposed at positions corresponding to the recording heads 17*a* and the recording heads 17*c* (see FIG. 3), respectively, in the line heads 11C to 11K. The wipers 35*b* are disposed at positions corresponding to the recording heads 17*b* (see FIG. 3) in the line heads 11C to 11K, and fixed so as to be shifted with respect to the wipers 35*a* and 35*c* by a predetermined distance in a direction (the arrow-AA' direction) orthogonal to a moving direction of the wiper carriage 31.

On an upper surface of the support frame 40, a collection tray 44 is disposed for collecting waste ink wiped off from the ink ejection surfaces F by the wipers 35*a* to 35*c*. At a substantially central part of the collection tray 44, a waste ink outlet (not shown) is formed, and a tray surface 44*a* and a tray surface 44*b* on opposite sides with respect to the waste ink outlet are each inclined downward toward the waste ink outlet. Waste ink wiped off from the ink ejection surface F by the wipers 35*a* to 35*c* to fall onto the tray surfaces 44*a* and 44*b* flows toward the waste ink outlet (not shown). Then, the waste ink passes through an ink collection path (not shown) connected to the waste ink outlet to be collected in the waste ink collection tank (not shown).

As illustrated in FIG. 8, the wipe unit 19 is housed in a carriage 80 which has a U-shaped sectional shape, and when at the second position, the wipe unit 19 is disposed below the cap unit 50. When the wipe unit 19 moves in the horizontal direction (the arrow-AA' direction) as illustrated in FIG. 8 and FIG. 12, the wipe unit 19 moves integrally with the carriage 80, and when the wipe unit 19 moves in the up-down direction as illustrated in FIG. 12 and FIG. 13, the wipe unit 19 moves in the up-down direction with respect to the carriage 80.

Figure 15:
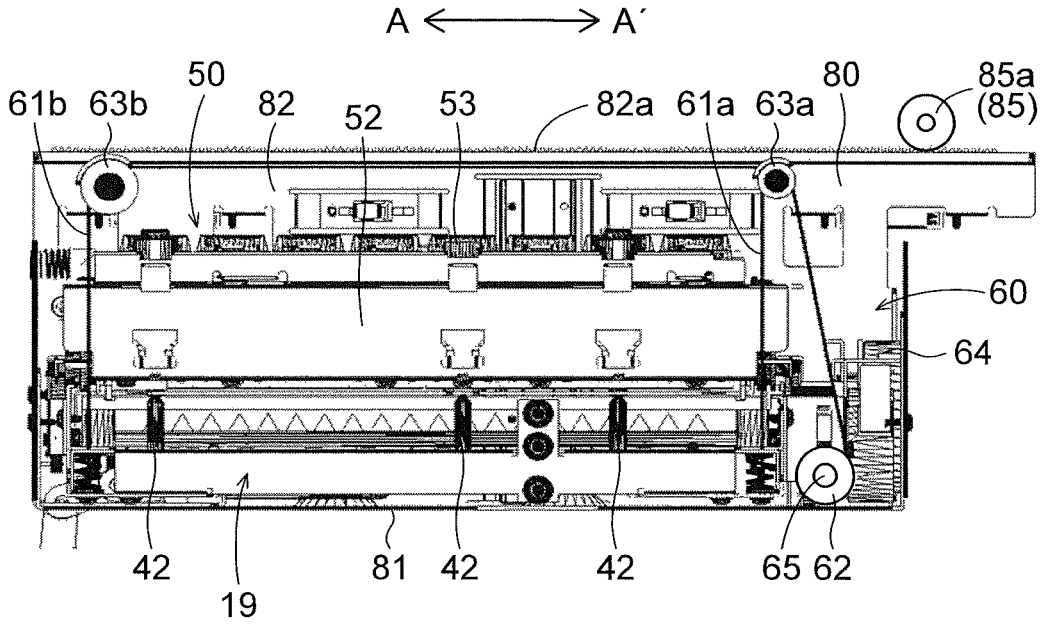
FIG. 15 is a diagram illustrating a structure around a unit ascending-descending mechanism of the printer according to the first embodiment of the present disclosure.

The carriage 80 is composed of a carriage bottom plate 81 (see FIG. 15) which is made of sheet metal and on which the wipe unit 19 is placed, and a pair of carriage side plates 82 standing at opposite ends of the carriage bottom plate 81 in the sheet width direction (the arrow-BB' direction). The carriage side plates 82 are configured to be slidable with respect to carriage support rails (not shown) of the printer main body 1. As illustrated in FIG. 15, on an upper surface of each of the carriage side plates 82, there is formed a rack portion 82*a* having rack teeth. Meshed with the rack portion 82*a* is a gear 85*a*, and a gear train including the gear 85*a* is connected to a carriage drive source (not shown) which is a motor. The carriage drive source rotates forward/reverse to cause the gear train to rotate forward/reverse, thereby causing the carriage 80 to reciprocate between the first position and the second position. The gear train including the gear 85*a* and the carriage drive source constitute a unit horizontal movement mechanism 85 that causes the cap unit 50 and the wipe unit 19 to move in the horizontal direction.

Inside the carriage 80, as illustrated in FIG. 15, there is provided a unit ascending/descending mechanism 60 which causes the wipe unit 19 to ascend/descend in the up-down direction. The unit ascending/descending mechanism 60 includes wires 61*a* and 61*b*, a winding pulley 62 which winds the wires 61*a* and 61*b*, pulleys 63*a* and 63*b* which change directions of the wires 61*a* and 61*b*, and a winding drive motor (a winding drive source) 64.

The wire 61*a* extends from the winding pulley 62 and is mounted, via the pulley 63*a*, to a lower portion of the wipe unit 19 in an arrow-A' direction. The wire 61*b* extends from the winding pulley 62 and is mounted, via the pulleys 63*a* and 63*b*, to a lower portion of the wipe unit 19 in the arrow-A direction. One set of the wires 61*a* and 61*b*, the winding pulley 62, and the pulleys 63*a* and 63*b* is provided on each of opposite sides in the arrow-BB' direction (on a near side and a far side with respect to the surface of the sheet on which FIG. 15 is drawn). The pair of winding pulleys 62 are fixed to opposite ends of a single rotation shaft 65. The rotation shaft 65 has a rotation shaft gear (not shown) fixed thereto, the rotation shaft gear being meshed with a gear train (not shown) which is connected to the winding drive motor 64. The winding drive motor 64 rotates forward/reverse to cause the winding pulleys 62 to rotate forward/reverse.

Figure 16:
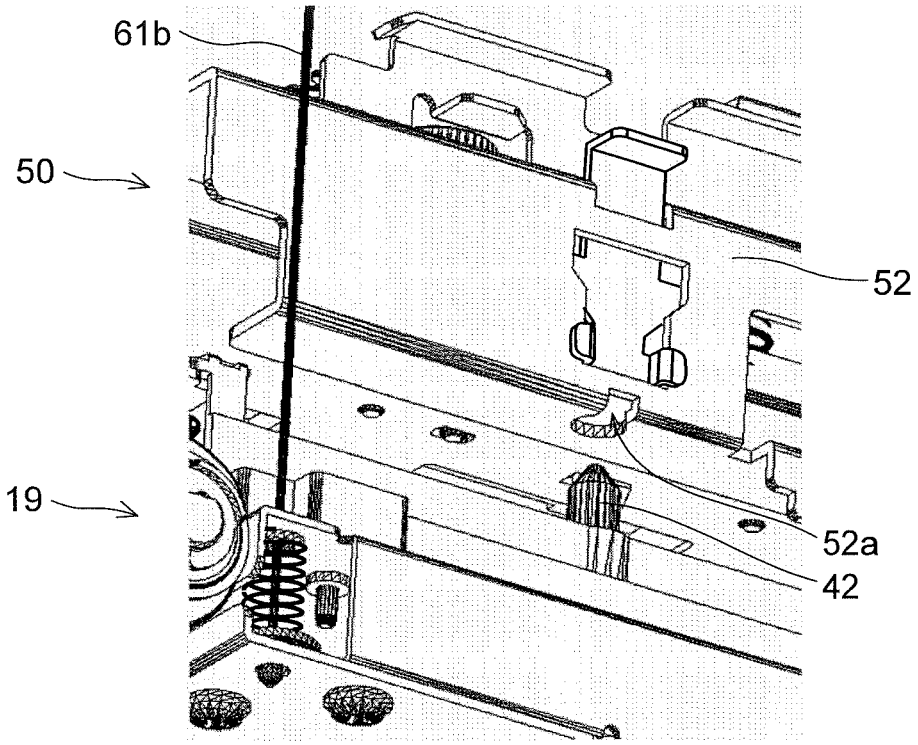
FIG. 16 is a diagram illustrating a structure around a connection pin and a push-up piece of the printer according to the first embodiment of the present disclosure, without the wipe unit and the cap unit connected to each other.

Furthermore, as illustrated in FIG. 15 and FIG. 16, the wipe unit 19 is provided with a plurality of connection pins 42 which extend upward. In a lower surface of each of the tray side plates 52 of the cap unit 50, connection holes 52*a* (see FIG. 16) are formed at positions corresponding to the connection pins 42. The connection pins 42 and the connection holes 52*a* constitute a connection mechanism for connecting the cap unit 50 and the wipe unit 19 to each other or disconnecting them from each other.

Figure 17:
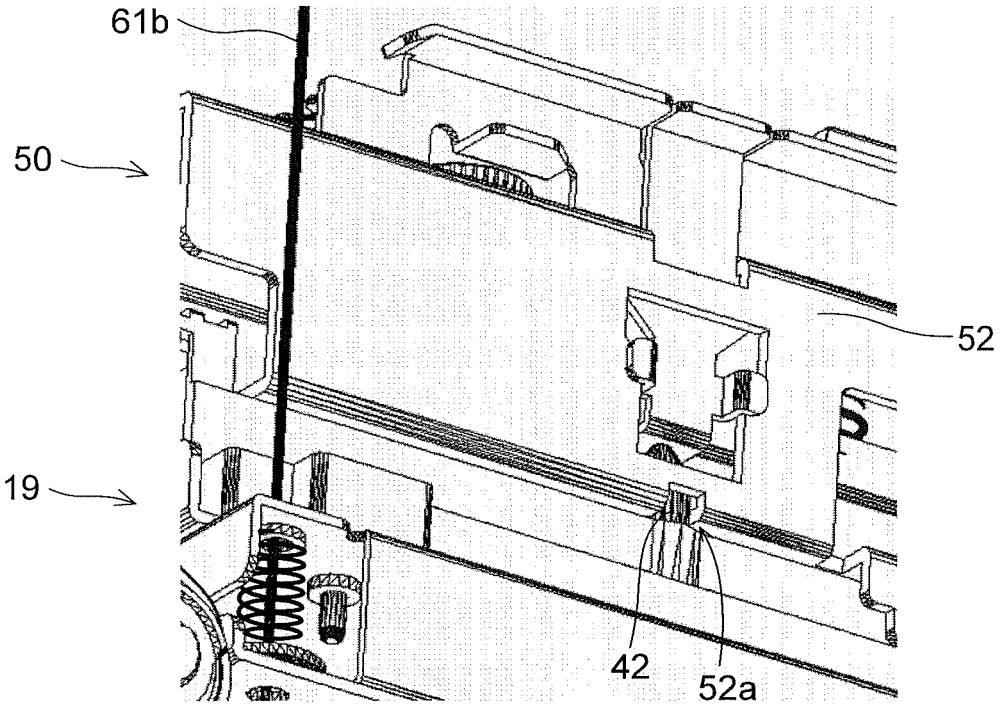
FIG. 17 is a diagram illustrating a structure around the connection pin and the push-up piece of the printer according to the first embodiment of the present disclosure, with the wipe unit and the cap unit connected to each other.

In a state where the wipe unit 19 has descended at the second position (the state in FIG. 15, the state of being disposed at a first height position), as illustrated in FIG. 16, the connection pins 42 are not inserted into the connection holes 52*a*, and thus the wipe unit 19 and the cap unit 50 are not connected to each other (disconnected from each other). On the other hand, when, at the second position, the wipe unit 19 ascends (to be disposed at a second height position, which is higher than the first height position), as illustrated in FIG. 17, the connection pins 42 are inserted into the connection holes 52*a*, and thus the wipe unit 19 and the cap unit 50 are connected to each other. In this state, it is possible for the cap unit 50 to move integrally with the wipe unit 19 in the horizontal direction and the up-down direction.

At the second position, there is provided a cap support portion (not shown) which supports the cap unit 50 in a state where the wipe unit 19 and the cap unit 50 are not connected to each other (in a state where they are disconnected from each other). At the second position, there is further provided a protection plate (not shown) which protects the cap portions 53 by closely contacting the cap portions 53 of the cap unit 50 in a state where the wipe unit 19 and the cap unit 50 are not connected to each other (a state other than where a capping operation is performed (a state where a printing operation or a recovery operation is performed)). The protection plate (not shown), by closely contacting the cap portions 53 from above, prevents foreign substances such as dust, paper powder, and so forth from adhering to upper surfaces (surfaces in close contact with the ink ejection surfaces F) of the cap portions 53, and also helps reduce loss of moisture from inside the cap portions 53 due to evaporation.

Next, a detailed description will be given of a configuration of the cap member 140 having the cap portion 53.

Figure 18:
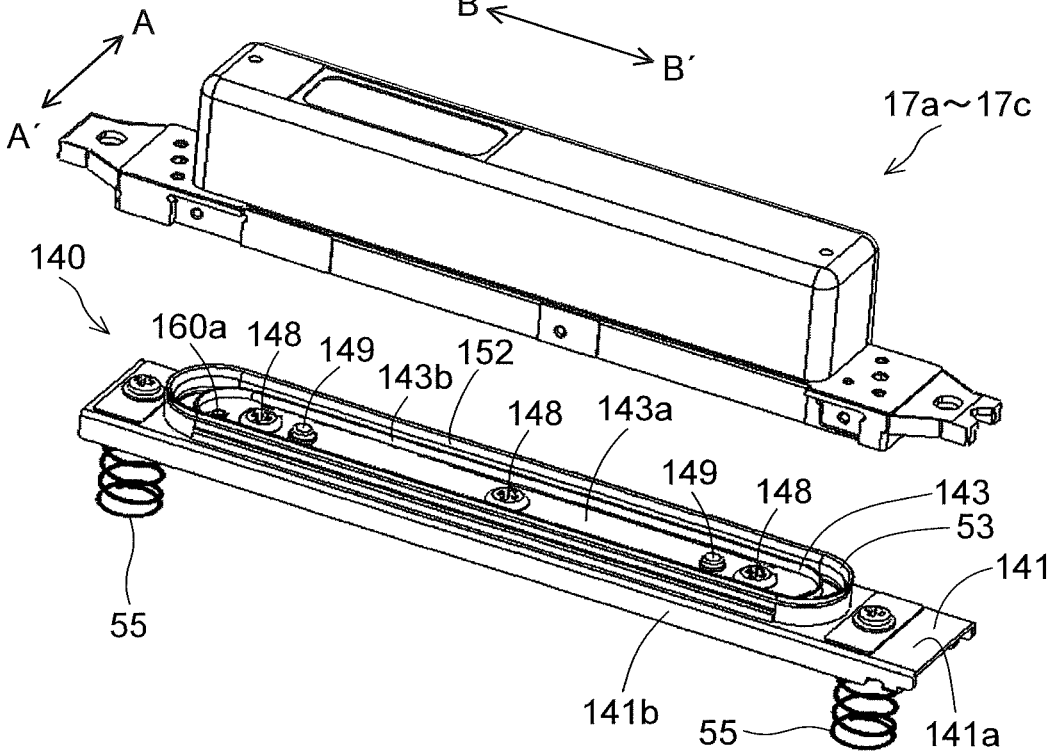
FIG. 18 is a diagram illustrating structures of the cap member and the recording head according to the first embodiment of the present disclosure.
Figure 19:
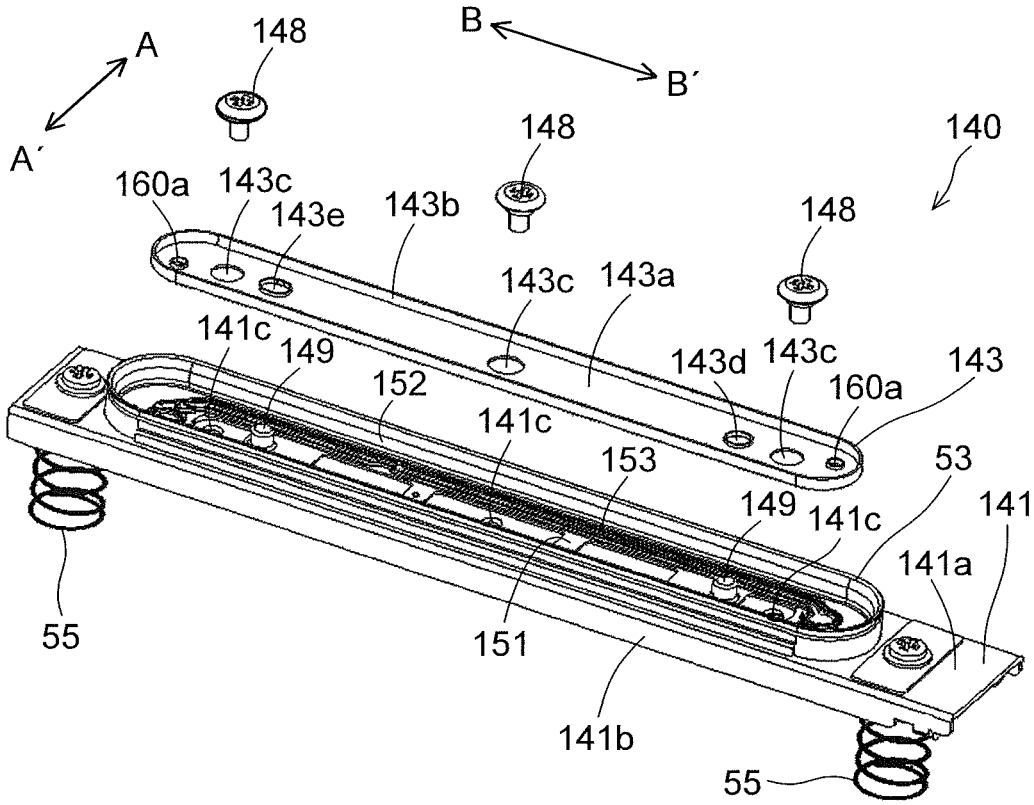
FIG. 19 is a diagram illustrating a structure of the cap member according to the first embodiment of the present disclosure.
Figure 20:
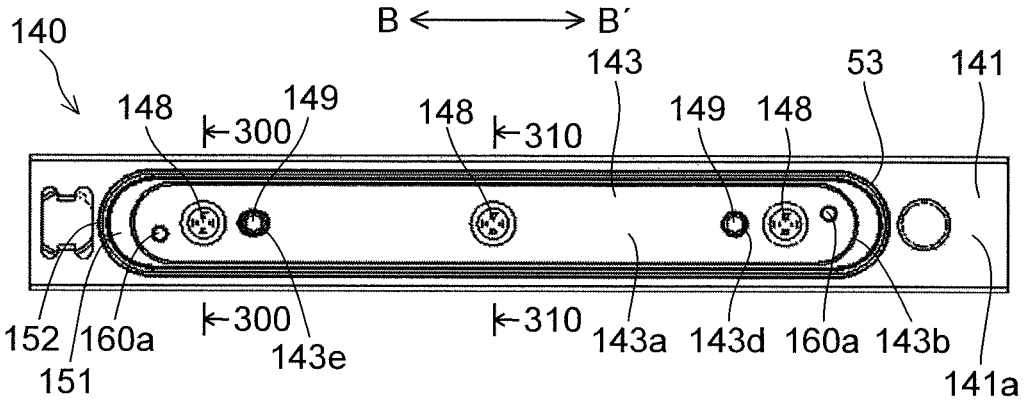
FIG. 20 is a diagram illustrating a structure of the cap member according to the first embodiment of the present disclosure as seen from above.

As illustrated in FIG. 18 and FIG. 19, the cap member 140 caps the ink ejection surface F (see FIG. 5) of each of the recording heads 17*a* to 17*c*. As illustrated in FIG. 19 and FIG. 20, the cap member 140 is composed of the cap portion 53, which is made of an elastic body (for example, a synthetic rubber having low elasticity and high resistance against deterioration, such as EPDM, butyl rubber, etc.), a support member 141, which is made of sheet metal and supports a lower surface of a later-described bottom surface portion 151 of the cap portion 53, and a lid member 143, which is made of sheet metal and disposed inside the cap portion 53.

Figure 21:
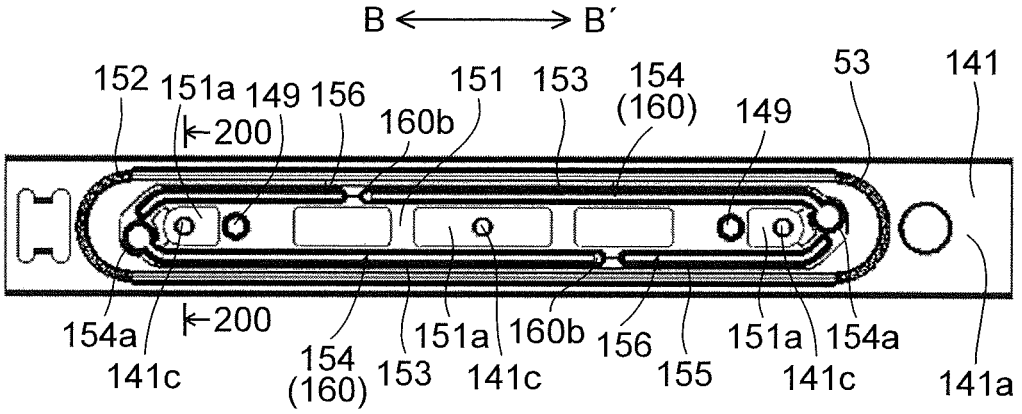
FIG. 21 is a diagram illustrating structures of a support member and a cap portion of the cap member according to the first embodiment of the present disclosure as seen from above.

As illustrated in FIG. 19 and FIG. 21, the cap portion 53 includes the bottom surface portion 151, which has an elliptical shape, and a side surface portion 152, which has a ring shape, stands on a periphery of the bottom surface portion 151, and contacts the ink ejection surface F.

Figure 22:
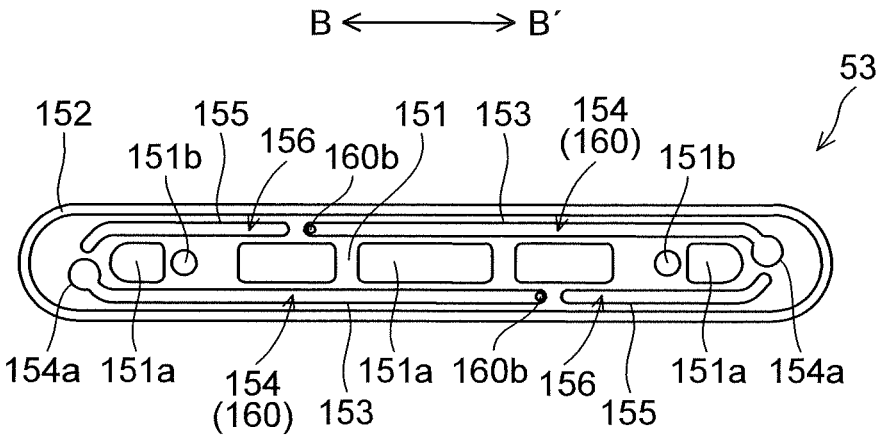
FIG. 22 is a diagram illustrating a structure of the cap portion of the cap member according to the first embodiment of the present disclosure as seen from above.
Figure 23:
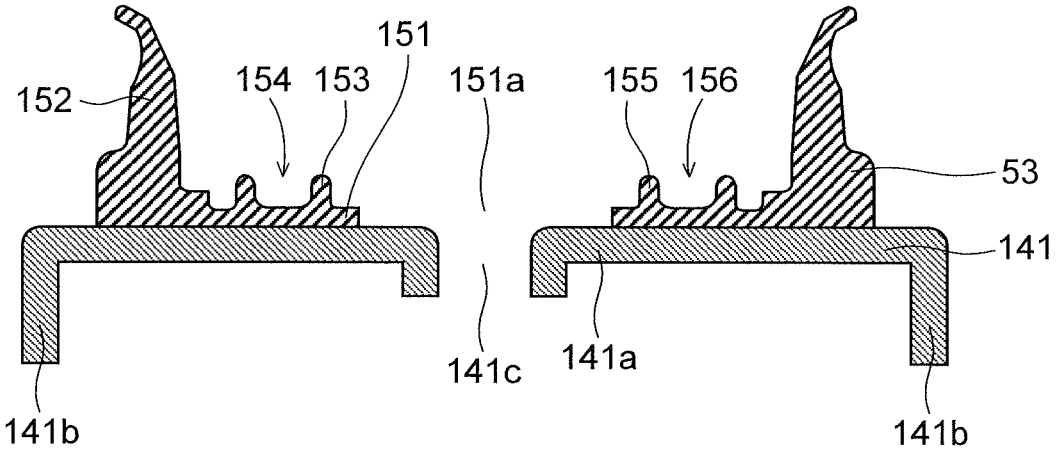
FIG. 23 is a sectional view taken along line 200-200 of FIG. 21.

Here, in this embodiment, as illustrated in FIG. 22 and FIG. 23, the bottom surface portion 151 of the cap portion 53 is provided with a groove portion 154 defined by a first rib 153 having a ring shape projecting upward from an upper surface of the bottom surface portion 151. The groove portion 154 is defined by the first rib 153 and the bottom surface portion 151. As illustrated in FIG. 22, two groove portions 154 are provided at positions point-symmetric to each other with respect to a center of the cap portion 53. One of the two groove portions 154 (the lower one of the groove portions 154 in FIG. 22) is formed to extend in an arrow-B' direction from the vicinity of an end portion of the cap portion 53 in the arrow-B direction. The other one of the groove portions 154 (the upper one of the groove portions 154 in FIG. 22) is formed to extend in the arrow-B direction from the vicinity of the end portion of the cap portion 53 in the arrow-B' direction.

Figure 24:
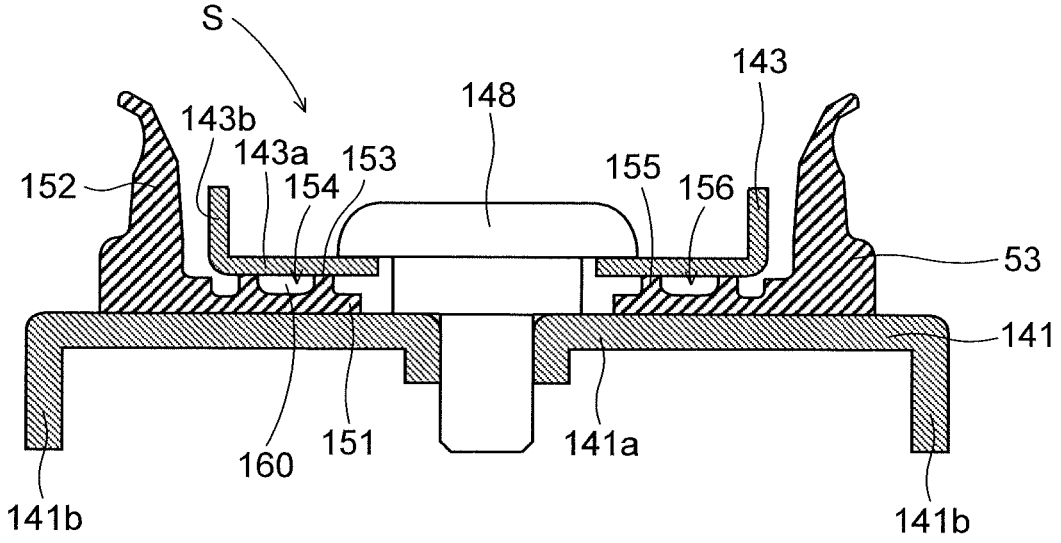
FIG. 24 is a sectional view taken along line 300-300 of FIG. 20.

As illustrated in FIG. 20 and FIG. 24, the lid member 143 is provided in close contact with an upper end of the first rib 153 so as to cover the groove portion 154. The groove portion 154 and the lid member 143 define an air passage 160 through which air passes. In this embodiment, two air passages 160 are defined by the two groove portions 154 and the one lid member 143. Here, one set of the groove portion 154 and the air passage 160 (the groove portion 154 and the air passage 160 on the lower side in FIG. 22) and the other set of the groove portion 154 and the air passage 160 (the groove portion 154 and the air passage 160 on the upper side in FIG. 22), which are disposed point-symmetrically to each other with respect to the center of the cap portion 53, are identical in shape, and thus a description of the other set of the groove portion 154 and the air passage 160 will be omitted.

One end portion (the end portion in the arrow-B direction) of the air passage 160 (the air passage 160 on the lower side in FIG. 22) is configured to communicate with an inner space S (see FIG. 24) of the cap portion 53, and the other end portion (the end portion in the arrow-B' direction) is configured to communicate with an outside of the cap portion 53.

Specifically, at the one end portion of the air passage 160, there is provided a first communication port 160*a* which allows communication between the air passage 160 and the inner space S of the cap portion 53. Here, as illustrated in FIG. 20, the first communication port 160*a* is provided in the lid member 143. One end (a left end in FIG. 22) of the groove portion 154 is formed as a circular portion 154*a* having a diameter that is greater than the width of the other portions of the groove portion 154. The circular portion 154*a* is disposed below the first communication port 160*a* (see FIG. 20). By forming such a portion (the circular portion 154*a*) of the groove portion 154 as corresponds to the first communication port 160*a* to have a diameter that is greater than the width of the other portions of the groove portion 154, it is possible to prevent the first communication port 160*a* from being closed up by the first rib 153 even when the lid member 143 is fixed in a state deviated in position with respect to the cap portion 53.

Furthermore, at the other end portion of the air passage 160, the groove portion 154 has a second communication port 160*b* formed in its bottom surface. In such a portion of the support member 141 as corresponds to the second communication port 160*b*, as illustrated in FIG. 25, there is provided a third communication port 160*c* which allows communication between the air passage 160 and the outside of the cap portion 53 via the second communication port 160*b*.

Accordingly, with the cap portion 53 capping the ink ejection surface F (see FIG. 5) of each of the recording heads 17*a* to 17*c*, the inner space S of the cap portion 53 communicates with the outside of the cap portion 53 via the air passage 160.

Figure 26:
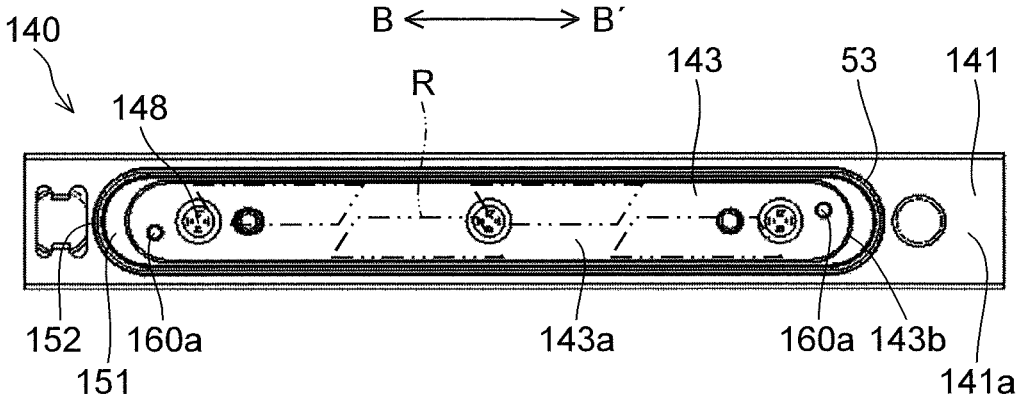
FIG. 26 is a diagram illustrating a structure of the cap member according to the first embodiment of the present disclosure as seen from above, the diagram illustrating a positional relationship between a first communication port and an ink ejection region of the recording head.

Here, as illustrated in FIG. 26, with the cap portions 53 capping the recording heads 17*a* to 17*c*, the first communication port 160*a* is provided at a retracted position retracted from a position directly below an ink ejection region R in which the ink ejection ports 18 are formed.

Figure 25:
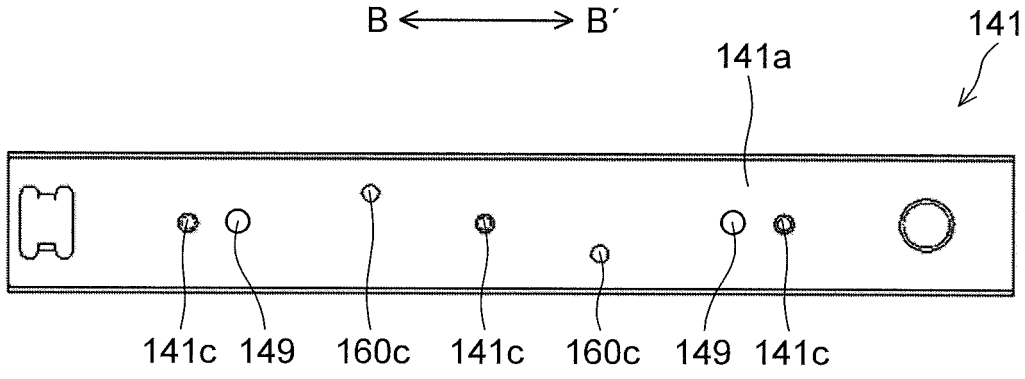
FIG. 25 is a diagram illustrating a structure of the support member of the cap member according to the first embodiment of the present disclosure as seen from above.

As illustrated in FIG. 19 and FIG. 25, the support member 141 is formed by bending sheet metal into a U-shaped sectional shape and has a support surface portion 141*a* extending in the arrow-BB' direction and a pair of bent side surface portions 141*b* extending downward from opposite ends of the support surface portion 141*a* in the arrow-AA' direction. Under each of opposite ends of the support surface portion 141*a* in the arrow-BB' direction, the above-described cap spring 55 is disposed. To the support surface portion 141*a,* the bottom surface portion 151 of the cap portion 53 is fixed with adhesive.

The support surface portion 141*a* has formed therein a plurality of (here, three) screw holes 141*c* which are threaded and aligned at predetermined intervals in the arrow-BB' direction, in each of which one of screws 148 is fitted. The support surface portion 141*a* also has two positioning bosses 149 fixed thereto. Here, the screws 148 are examples of "pressing member" of the present disclosure, and, as will be described later, the screws 148 fix the lid member 143 to the support member 141, with the lid member 143 pressed against the first ribs 153.

As illustrated in FIG. 22, in the bottom surface portion 151 of the cap portion 53, there are formed three openings 151*a,* in each of which one of the screws 148 is inserted, and there are also formed two positioning holes 151*b,* in each of which one of the positioning bosses 149 (see FIG. 25) is inserted. With the positioning bosses 149 inserted in the positioning holes 151*b,* as illustrated in FIG. 21, the cap portion 53 is positioned to a predetermined position on the support member 141.

As illustrated in FIG. 22 and FIG. 23, on the bottom surface portion 151, there are provided a plurality of (here, two) second ribs 155 which each have a ring-shape and project from the upper surface of the bottom surface portion 151 by an amount equal to the amount by which the first ribs 153 project from the upper surface of the bottom surface portion 151. Like the first ribs 153, the two second ribs 155 are provided at positions point-symmetric to each other with respect to the center of the cap portion 53. As illustrated in FIG. 24, the lid member is provided in close contact with an upper end of each of the second ribs 155 in the same manner as with the first ribs 153. Note that, although the second ribs 155, like the first ribs 153, each define a groove portion 156, the groove portion 156 and the lid member 143 do not define an air passage.

As illustrated in FIG. 22, the second ribs 155 are arranged at positions at which the first ribs 153 would be if they were extended. Specifically, the first ribs 153 are provided along an edge portion of the lid member 143, and the second ribs 155 are provided along such part of the edge portion of the lid member 143 as is provided with no first rib 153. With this arrangement, the first ribs 153 and the second ribs 155 together support substantially the entire edge portion of the lid member 143.

As illustrated in FIG. 19 and FIG. 20, the lid member 143 has a close-contact surface portion 143*a* which extends in the arrow-BB' direction and is in close contact with the first ribs 153 and the second ribs 155, and a side surface portion 143*b* having a ring shape and standing at a periphery of the close-contact surface portion 143*a*. The side surface portion 143*b* has a height such that it does not contact the ink ejection surface F.

In the close-contact surface portion 143*a,* at positions corresponding to the screw holes 141*c,* there are formed three insertion holes 143*c* in which the screws 148 are inserted. In the close-contact surface portion 143*a,* there are also formed two positioning holes 143*d* and 143*e* in which the positioning bosses 149 are inserted. The positioning hole 143*d* is formed in a round shape, and the positioning hole 143*e* is formed in an elliptical shape.

Figure 27:
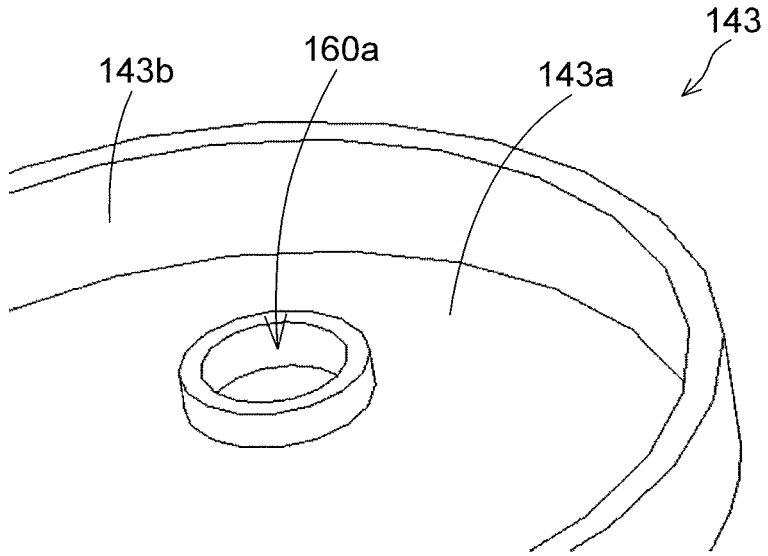
FIG. 27 is a diagram illustrating a structure around the first communication port of a lid member of the cap member according to the first embodiment of the present disclosure.
Figure 28:
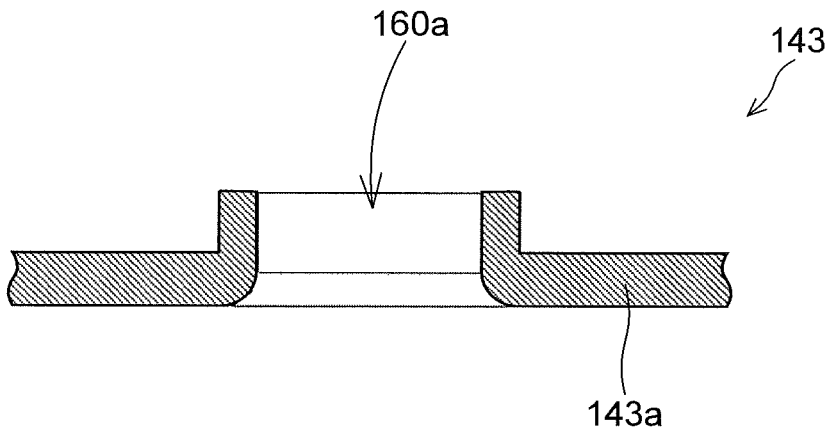
FIG. 28 is a diagram illustrating a structure around the first communication port of the lid member of the cap member according to the first embodiment of the present disclosure.

The close-contact surface portion 143*a* is further provided with the above-described first communication port 160*a*. As illustrated in FIG. 27 and FIG. 28, the first communication port 160*a* is formed by burring such that a periphery of the first communication port 160*a* projects upward from an upper surface of the close-contact surface portion 143*a*. Like the first communication port 160*a,* the positioning holes 143*d* and 143*e* are also formed by burring such that peripheries of the positioning holes 143*d* and 143*e* also project upward from the upper surface of the close-contact surface portion 143*a*.

Next, a more detailed description will be given of the air passage 160 of the cap member 140.

The groove portion 154 defining the air passage 160 is provided to extend in the arrow-BB' direction (the predetermined direction).

Figure 29:
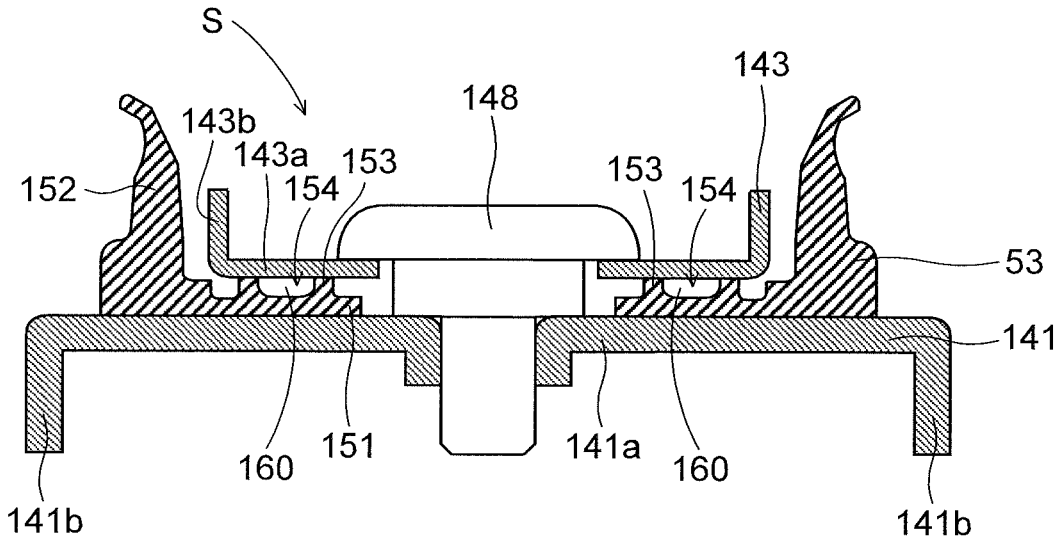
FIG. 29 is a sectional view taken along line 310-310 of FIG. 20.
Figure 30:
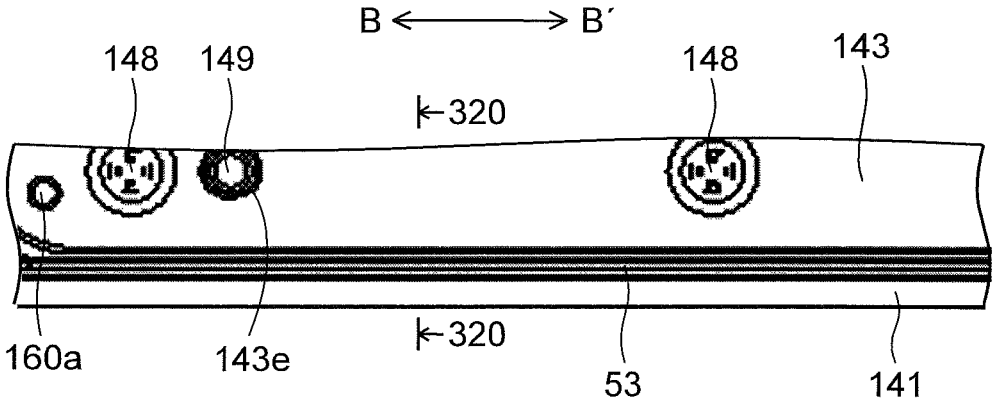
FIG. 30 is a partially enlarged view of FIG. 20.
Figure 31:
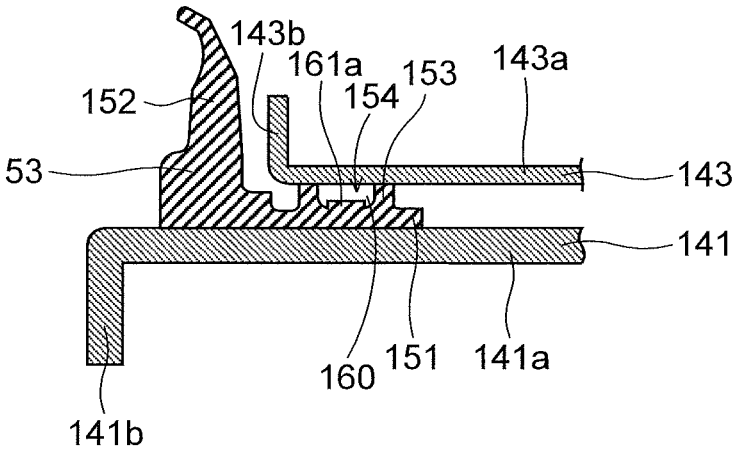
FIG. 31 is a sectional view taken along line 320-320 of FIG. 30.

Here, the lid member 143 is fixed by using the screws 148 arranged at predetermined intervals in the arrow-BB' direction (the predetermined direction) so as to press the first ribs 153 and the second ribs 155 downward, and thus, as illustrated in FIG. 24 and FIG. 29, such part of the first ribs 153 and the second ribs 155 as is located opposite any one of the screws 148 is compressed and deformed by a large amount. On the other hand, as illustrated in FIG. 30 and FIG. 31, such part of the first ribs 153 as is located opposite an intermediate portion between adjacent ones of the screws 148 is compressed and deformed by a small amount. As a result, the lid member 143 is bent such that such part thereof as is located opposite an intermediate portion between adjacent ones of the screws 148 illustrated in FIG. 31 is more upward than such part thereof as is located opposite any one of the screws 148 as illustrated in FIG. 24 and FIG. 29.

Figure 32:
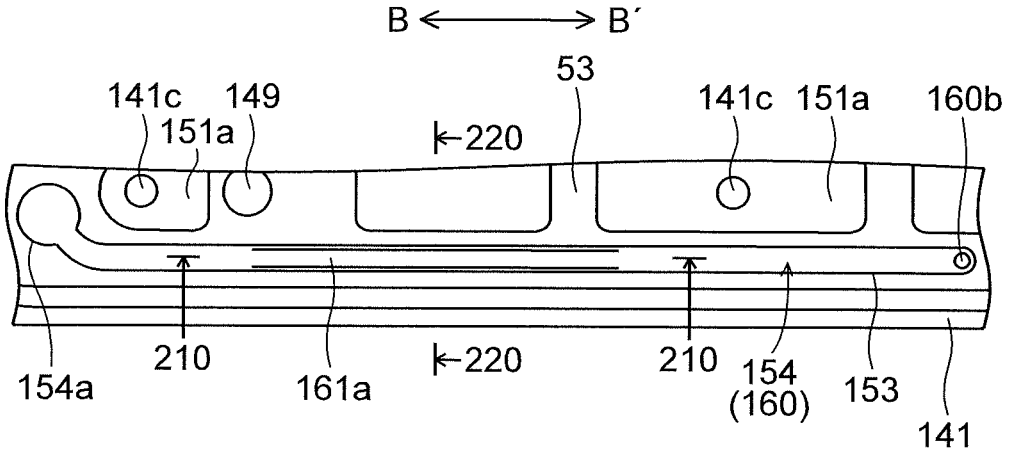
FIG. 32 is a partially enlarged view of FIG. 21.
Figure 33:
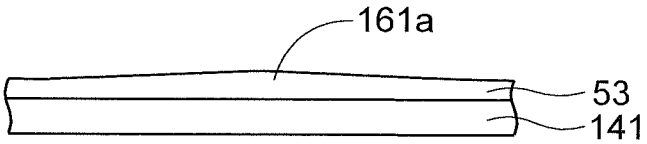
FIG. 33 is a sectional view taken along line 210-210 of FIG. 32.
Figure 34:
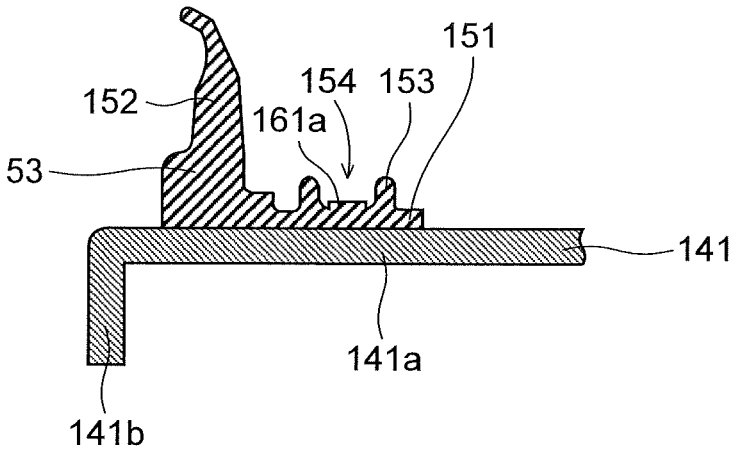
FIG. 34 is a sectional view taken along line 220-220 of FIG. 32.

To deal with this, in this embodiment, as illustrated in FIG. 32 to FIG. 34, on an inner surface (here, a bottom surface) of the groove portion 154, at such part thereof as is located opposite an intermediate portion between adjacent ones of the screws 148 (in FIG. 32, adjacent ones of the screw holes 141*c*), there is provided a convex portion 161*a,* which is mountain-shaped and projects into the air passage 160. The convex portion 161*a* is formed to extend along the groove portion 154. The convex portion 161*a* is formed such that a projection amount thereof is gradually increased from a position adjacent to such part of the groove portion 154 as is located opposite any one of the screws 148 (a position in the vicinity of such part of the groove portion 154 as is located opposite any one of the screws 148) toward such part of the groove portion 154 as is located opposite an intermediate portion between adjacent ones of the screws 148. As a result, a sectional area of the air passage 160 is substantially constant along a longitudinal direction of the air passage 160. Here, an angle of inclination of an upper surface of the convex portion 161*a* is set at, for example, several tenths degrees to five degrees.

Next, a description will be given of how the cap member 140 is assembled.

As illustrated in FIG. 19 and FIG. 21, the positioning bosses 149 of the support member 141 are inserted from below into the positioning holes 151*b* (see FIG. 22) of the cap portion 53, and the bottom surface portion 151 of the cap portion 53 and the support surface portion 141*a* of the support member 141 are fixed to each other with adhesive. Here, in this embodiment, since the screws 148 are used to fix the lid member 143 to the support member 141 in a state of being pressed against the support member 141, the cap portion 53 does not have to be fixed to the support member 141 with adhesive. The positioning bosses 149 are inserted from below into the positioning holes 143*d* and 143*e* of the lid member 143, and the close-contact surface portion 143*a* of the lid member 143 is brought into close contact with the upper ends of the first ribs 153 and the second ribs 155 of the cap portion 53.

Then, by fitting the screws 148 into the screw holes 141*c*, as illustrated in FIG. 18 and FIG. 20, the lid member 143 is fixed to the support member 141 in a state of being pressed against the support member 141. Thereby, as illustrated in FIG. 24, the edges of the first ribs 153 and the second ribs 155 are deformed along, and brought into close contact with, a lower surface of the lid member 143. In this manner, the cap member 140 is assembled.

Next, a description will be given of an operation (the capping operation) of putting the cap unit 50 on the recording heads 17*a* to 17*c*, performed in the printer 100 of this embodiment. A capping operation and a recovery operation described below are executed by controlling the operations of the recording heads 17*a* to 17*c*, the wipe unit 19, the unit ascending/descending mechanism 60, the unit horizontal movement mechanism 85, the conveyance ascending/descending mechanism, various drive sources, etc. based on a control signal from the control portion 110 (see FIG. 1).

To cap the recording heads 17*a* to 17*c* with the cap unit 50, the first conveyance unit 5, disposed opposite a lower surface of the recording portion 9 (see FIG. 1), is caused to descend, as shown in FIG. 8, from its position in FIG. 7. At this time, the wipe unit 19 is disposed at the first height position, and thus the wipe unit 19 and the cap unit 50 are not connected to each other.

Then, by the unit ascending/descending mechanism 60 (see FIG. 15), the wipe unit 19 is caused to ascend from the first height position to the second height position. Consequently, as shown in FIG. 17, the connection pins 42 are inserted into the connection holes 52*a*, and thereby the wipe unit 19 and the cap unit 50 are connected to each other.

Thereafter, as shown in FIG. 9, the carriage 80 is horizontally moved from the second position to the first position, and thereby, the cap unit 50, in a state of being joined to an upper surface of the wipe unit 19, moves horizontally from the second position to the first position.

Then, by the unit ascending/descending mechanism 60, as shown in FIG. 10, the wipe unit 19 and the cap unit 50 are caused to ascend. At a time point when the cap portions 53 of the cap unit 50 come into close contact with the ink ejection surfaces F of the recording heads 17*a* to 17*c*, the winding drive motor 64 (see FIG. 15) is stopped rotating, and this completes the capping of the recording heads 17*a* to 17*c* with the cap unit 50.

At this time, the cap portions 53 are further ascended by several millimeters after upper ends of the side surface portions 152 of the cap portions 53 come into contact with the recording heads 17*a* to 17*c*, and then the ascending of the cap portions 53 is stopped, that is, the ascending of the cap portions 53 is stopped with the side surface portions 152 of the cap portions 53 compressed in the up-down direction. As a result, air pressure (inner pressure) in the inner space S of each cap portion 53 increases, but in this embodiment, since the inner space S of each cap portion 53 communicates via the air passage 160 with the outside of the cap portion 53, air in the inner space S of the cap portion 53 is discharged via the air passage 160 to the outside of the cap portion 53. This helps moderate the increase of air pressure in the inner space S of the cap portion 53, and thus helps prevent destruction of the meniscus M (see FIG. 6) at the ink ejection port 18.

Here, to separate the cap portions 53 from the recording heads 17*a* to 17*c* (in a case of shifting to a printing operation or to a recovery operation), an operation reverse to the above-described operation is performed, and thus the operation will be described briefly.

At the first position, by the unit ascending/descending mechanism 60, the wipe unit 19 and the cap unit 50 are caused to descend until the wipe unit 19 comes to the second height position. Thereby, the cap portions 53 are separated from the ink ejection surfaces F.

At this time, from the state where the side surface portions 152 of the cap portions 53 is compressed in the up-down direction, the cap portions 53 are descended to a position about several millimeters below, where the upper ends of the side surface portions 152 of the cap portions 53 are separated from the recording heads 17*a* to 17*c*. As a result, air pressure (inner pressure) in the inner space S of each cap portion 53 is reduced, but in this embodiment, since the inner space S of each cap portion 53 communicates with the outside of the cap portion 53 via the air passage 160, air existing outside the cap portion 53 flows via the air passage 160 into the inner space S of the cap portion 53. This helps moderate the reduction of air pressure in the inner space S of the cap portion 53, and thus helps prevent destruction of the meniscus M (see FIG. 6) at the ink ejection port 18.

Then, the carriage 80 is horizontally moved from the first position to the second position, to thereby dispose the wipe unit 19 and the cap unit 50 at the second position, with the wipe unit 19 and the cap unit 50 connected to each other.

Thereafter, at the second position, by the unit ascending/descending mechanism 60, the wipe unit 19 is caused to descend from the second height position to the first height position. Consequently, the connection pins 42 come out of the connection holes 52*a*, and thus the wipe unit 19 and the cap unit 50 are disconnected from each other. In this manner, the state shown in FIG. 8 is restored.

Next, a description will be given of the recovery operation performed with respect to the recording heads 17*a* to 17*c* in the printer 100 of this embodiment.

In a case of performing a recovery process with respect to the recording heads 17*a* to 17*c* by means of the wipe unit 19, as shown in FIG. 8, the first conveyance unit 5 disposed opposite the lower surface of the recording portion 9 (see FIG. 1) is caused to descend from the state illustrated in FIG. 7. At this time, the wipe unit 19 is disposed at the first height position, and the wipe unit 19 and the cap unit 50 are not connected to each other.

Then, as shown in FIG. 12, with the cap unit 50 left at the second position, the carriage 80 is horizontally moved from the second position to the first position, and thereby the wipe unit 19 is horizontally moved, at the first height position, from the second position to the first position.

Then, by the unit ascending/descending mechanism 60, the wipe unit 19 is caused to ascend as shown in FIG. 13. Thereby, the wipers 35*a* to 35*c* of the wipe unit 19 are brought into pressure contact with the ink ejection surfaces F of the recording heads 17*a* to 17*c* at wiping start positions on the ink ejection surfaces F.

Then, prior to a wiping operation, ink is supplied to the recording heads 17*a* to 17*c*. The ink thus supplied is forcibly extruded (purged) through the ink ejection ports 18 (see FIG. 2). By this purging operation, thickened ink, a foreign substance, and air bubbles are discharged from the ink ejection ports 18. At this time, the purged ink is extruded onto the ink ejection surface F along a shape of each ink ejection region R (see FIG. 5) in which the ink ejection ports 18 are present.

Thereafter, a wiping operation is performed in which the ink (the purged ink) extruded onto the ink ejection surfaces F is wiped off. Specifically, the wiper carriage movement motor 45 is caused to rotate forward from the state shown in FIG. 13, and thereby the wiper carriage 31 is caused to horizontally move in the arrow-B direction as shown in FIG. 14, such that the wipers 35*a* to 35*c* wipe off the ink extruded onto the ink ejection surfaces F of the recording heads 17*a* to 17*c*. Waste ink thus wiped off by the wipers 35*a* to 35*c* is collected in the collection tray 44 disposed in the wipe unit 19.

Thereafter, by the unit ascending/descending mechanism 60 (see FIG. 15), as shown in FIG. 12, the wipe unit 19 is caused to descend to the first height position, and thereby the wipers 35*a* to 35*c* are separated downward from the ink ejection surfaces F of the recording heads 17*a* to 17*c*. Then, the wiper carriage 31 is moved in a direction (the arrow-B' direction) that is opposite to the direction of wiping, to bring the wipe unit 19 back into its original state.

Then, the carriage 80 and the wipe unit 19 disposed at the first position are horizontally moved from the first position to the second position. Consequently, the wipe unit 19 is disposed below the cap unit 50. In this manner, the recovery operation with respect to the recording heads 17*a* to 17*c* is completed.

In this embodiment, as described above, one end portion of the air passage 160 communicates with the inner space S of the cap portion 53, and the other end portion of the air passage 160 communicates with the outside of the cap portion 53. Consequently, the inner space S of the cap portion 53 communicates with the outside of the cap portion 53 via the air passage 160. Consequently, in bringing the cap portions 53 into pressure contact with the ink ejection surfaces F (capping) or separating the cap portions 53 from the ink ejection surfaces F, it is possible to moderate the variation in air pressure in the inner space S of each cap portion 53, and thus to prevent destruction of the meniscus M.

The bottom surface portion 151 of each cap portion 53 is provided with the groove portion 154 defined by the first rib 153 projecting from the upper surface of the bottom surface portion 151, and on the upper end of the first rib 153, the lid member 143 covering the groove portion 154 is provide in close contact with the upper end of the first rib 153, such that the groove portion 154 and the lid member 143 define the air passage 160 through which air passes. Consequently, in contrast to the conventional inkjet recording apparatus described far above, there exists no connection portion between a cap portion and a tube, and thus there occurs no leakage of vapor (evaporated ink) through a connection portion. Further, even if vapor leaks through a side surface (the first rib 153) of the air passage 160 (that is, even if vapor passes through a side surface (the first rib 153) in its thickness direction), the vapor just returns into the inner space S of the cap portion 53, and thus the inner space S of the cap portion 53 does not become dry. Accordingly, it is possible to prevent the inner space S of the cap portion 53 from becoming dry, and thus to prevent clogging of the ink ejection ports 18. Here, the support member 141 made of sheet metal is provided on the lower surface of the bottom surface portion 151 of the cap portion 53, and thus no vapor leaks through the bottom surface of the air passage 160 (that is, the bottom surface of the groove portion 154).

Furthermore, as described above, at one end portion of the air passage 160, the first communication port 160*a* is provided which allows communication between the air passage 160 and the inner space S of the cap portion 53; at the other end portion of the air passage 160, the second communication port 160*b* is provided in the bottom surface of the groove portion 154; and at such a portion of the support member 141 as corresponds to the second communication port 160*b*, the third communication port 160*c* is provided which allows communication, via the second communication port 160*b*, between the air passage 160 and the outside of the cap portion 53. Consequently, it is possible to easily allow the one end of the air passage 160 to communicate with the inner space S of the cap portion 53, and to easily allow the other end portion of the air passage 160 to communicate with the outside of the cap portion 53.

As described above, the first communication port 160*a* is provided in the lid member 143. Consequently, it is possible to easily allow communication between the air passage 160 and the inner space S of the cap portion 53.

As described above, the periphery of the first communication port 160*a* projects upward from the upper surface of the lid member 143. Consequently, even if ink drops from an ink ejection port 18 onto the lid member 143, it is possible to prevent the dropped ink from flowing into the first communication port 160*a*. This helps prevent the air passage 160 from becoming clogged with ink.

As described above, as the air passage 160, a plurality of (here, two) air passages 160 are provided. Consequently, even if one of the air passages 160 becomes clogged with ink, it is possible to maintain the communication between the inner space S of the cap portion 53 and the outside of the cap portion 53 via the other air passage 160.

As described above, a plurality of (here, two) groove portions 154 and one lid member 143 define a plurality of (here, two) air passages 160. Consequently, the plurality of air passages 160 are provided without increase in the number of components.

As described above, the bottom surface portion 151 of the cap portion 53 is provided with the second ribs 155 which project from the upper surface of the bottom surface portion 151 by an amount equal to the amount by which the first ribs 153 project from the upper surface of the bottom surface portion 151, and on which the lid member 143 is disposed to be in close contact with the upper ends of the second ribs 155. Consequently, it is possible to support the lid member 143 with the first and second ribs 153 and 155, and thus to prevent the lid member 143 from being fixed in a state of being inclined with respect to the support member 141.

As described above, as the first rib 153, two first ribs 153 are provided along the edge portion of the lid member 143, at positions point-symmetric to each other with respect to the center of the cap portion 53, and as the second rib 155, two second ribs 155 are provided along such part of the edge portion of the lid member 143 as is provided with no first rib 153, at positions point-symmetric to each other with respect to the center of the cap portion 53. Consequently, it is possible to support substantially the entire edge portion of the lid member 143 with the first ribs 153 and the second ribs 155, and this helps further effectively prevent the lid member 143 from being fixed in a state of being inclined with respect to the support member 141.

As described above, the lid member 143 is pressed against the first ribs 153 with the three screws 148, which are disposed at predetermined intervals in the arrow-BB' direction. Consequently, the first ribs 153 are compressed downward by pressure force from the screws 148. At this time, such part of the first ribs 153 as is located opposite an intermediate portion between adjacent ones of the screws 148 is compressed by a smaller amount than such part of the first ribs 153 as is located opposite any one of the screws 148. As a result, such part of the air passage 160 as is located opposite an intermediate portion between adjacent ones of the screws 148 has a larger sectional area than such part of the air passage 160 as is located opposite any one of the screws 148.

This is dealt with, in this embodiment, as described above, by providing the convex portion 161*a*, which is mountain-shaped and projects into the air passage 160, on such part of the inner surface of the groove portion 154 as is located opposite an intermediate portion between adjacent ones of the screws 148. Consequently, it is possible to prevent the sectional area of the air passage 160 from becoming larger at such part thereof as is located opposite an intermediate portion between adjacent ones of the screws 148 than at such part thereof as is located opposite any one of the screws 148. Thus, it is possible to prevent the sectional area of the air passage 160 from varying along the longitudinal direction of the air passage 160, and thus to achieve a smooth flow of air in the air passage 160. As a result, in bringing the cap portions 53 into pressure contact with the ink ejection surfaces F (capping) or separating the cap portions 53 from the ink ejection surfaces F, it is possible to moderate the variation in air pressure in the inner space S of each cap portion 53, and thus to more effectively prevent destruction of the meniscus M.

If the sectional area of the air passage 160 varies along the longitudinal direction of the air passage 160, air stagnates at a region (space) with a large sectional area, and this prevents achievement of a smooth airflow in the air passage 160.

As described above, the convex portion 161*a* is formed such that the projection amount thereof gradually increases from a position adjacent to such part of the groove portion 154 as is located opposite any one of the screws 148 toward such part of the groove portion 154 as is located opposite an intermediate portion between adjacent ones of the screws 148. Consequently, it is possible to easily prevent the sectional area of the air passage 160 from varying along the longitudinal direction of the air passage 160.

As described above, the convex portion 161*a* is provided on the bottom surface of the groove portion 154. With the convex portion 161*a* provided on the bottom surface of the groove portion 154, no pressure force is applied to the convex portion 161*a* from the screws 148, and thus the convex portion 161*a* does not become deformed. As a result, it is possible to easily design the shape of the convex portion 161*a*.

As described above, with the cap portions 53 capping the recording heads 17*a* to 17*c*, the first communication port 160*a* is provided at the retracted position retracted from the position directly below the ink ejection ports 18. Consequently, even when ink drops from an ink ejection port 18, it is possible to prevent the dropped ink from flowing into the first communication port 160*a*.

Second Embodiment

Figure 35:
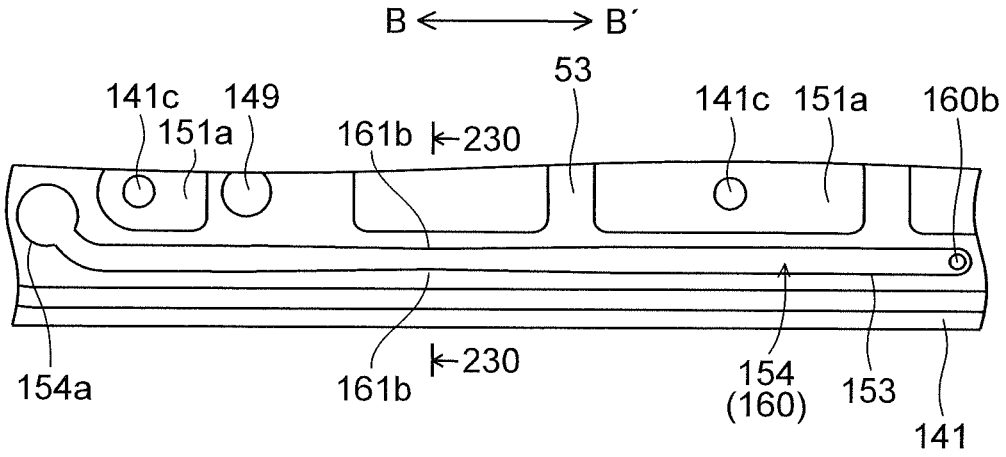
FIG. 35 is a partially enlarged view of structures of a support member and a cap portion of a cap member according to a second embodiment of the present disclosure as seen from above.
Figure 36:
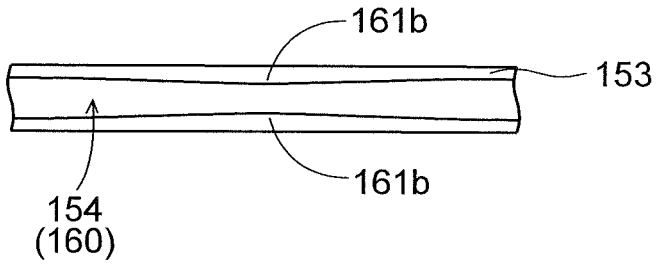
FIG. 36 is a diagram illustrating a structure of a convex portion of the cap member according to the second embodiment of the present disclosure.
Figure 37:
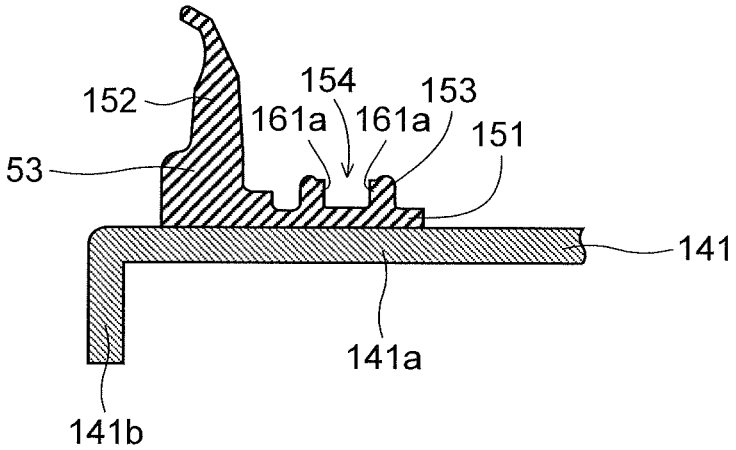
FIG. 37 is a sectional view taken along line 230-230 of FIG. 35.

In a cap member 140 according to a second embodiment of the present disclosure, as illustrated in FIG. 35 to FIG. 37, on side surfaces of a first rib 153 defining a groove portion 154, at such part as is located opposite an intermediate portion between adjacent ones of screws 148 (in FIG. 35, adjacent ones of screw holes 141*c*), there are provided convex portions 161*b*, each mountain-shaped and projecting into the air passage 160. Thus, like in the first embodiment, the sectional area of the air passage 160 is substantially constant along the longitudinal direction of the air passage 160. Here, in this embodiment, the convex portions 161*b* are provided one on each of the side surfaces of the groove portion 154.

Other structures, the method for assembling the cap member 140, the capping operation, and the recovery operation of the second embodiment are similar to those of the first embodiment.

In this embodiment, as described above, the side surfaces of the groove portion 154 are each provided with one of the convex portions 161*b*, each mountain-shaped and projecting into the air passage 160. Consequently, like in the first embodiment, it is possible to prevent the sectional area of the air passage 160 from becoming larger at such part of the air passage 160 as is located opposite an intermediate portion between adjacent ones of the screws 148 than at such part of the air passage 160 as is located opposite any one of the screws 148, and thus to achieve a smooth airflow in the air passage 160. Thus, in bringing the cap portions 53 into pressure contact with the ink ejection surfaces F (capping) or separating the cap portions 53 from the ink ejection surfaces F, it is possible to more effectively prevent destruction of a meniscus M.

Other advantages of the second embodiment are similar to those of the first embodiment described above.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the above embodiments have dealt with examples where the recovery operation with respect to the recording heads 17*a* to 17*c* is performed by using only ink (purge ink), but the recovery operation with respect to the recording heads 17*a* to 17*c* may instead be performed by using ink and cleaning liquid.

The above embodiments have dealt with examples where the screws 148 are used to fix the lid member 143 in a state of being pressed against the support member 141, but this is by no means meant to limit the scope of the present disclosure. For example, the lid member 143 may be fixed to the support member 141, for example, by using swaging pins, by press fitting pins into through holes in the support member 141, etc. Further, the lid member 143 may be fixed to the first ribs 153 of the cap portion 53 with adhesive, for example.

Although the above embodiments have dealt with examples where the first communication port 160*a* is provided in the lid member 143, they are not meant to limit the scope of the present disclosure. For example, a first communication port allowing communication between the air passage 160 and the inner space S of the cap portion 53 may be provided by providing an opening hole, a cut, or the like in the side surface portion 152 of the cap portion 53.

For example, the second embodiment has dealt with an example where the convex portion 161*b* is provided on the side surfaces of the groove portion 154, but this not meant to limit the scope of the present disclosure, and the convex portion 16*b* may be provided on just one side surface of the groove portion 154.

The above embodiments have dealt with examples where a convex portion is provided either on the bottom surface or on the side surfaces of the groove portion 154, but they are not meant to limit the scope of the present disclosure, and a convex portion may be provided both on the bottom and side surfaces of the groove portion 154. Or, no convex portion may be provided on an inner surface of the groove portion 154.

What is claimed is:

1. A cap member for capping an ink ejection surface of a recording head, the ink ejection surface having an ink ejection port formed therein, the cap member comprising:

a cap portion which is an elastic body having a bottom surface portion and a side surface portion which is ring-shaped, stands on the bottom surface portion, and contacts the ink ejection surface; and a support member which is made of sheet metal, and supports a lower surface of the bottom surface portion of the cap portion, wherein the bottom surface portion of the cap portion is provided with a groove portion which is defined by a first rib projecting from an upper surface of the bottom surface portion, a lid member which covers the groove portion is provided on, and in close contact with, an upper end of the first rib, the groove portion and the lid member define an air passage through which air passes, one end portion of the air passage communicates with an inner space of the cap portion, and another end portion of the air passage communicates with an outside of the cap portion.

2. The cap member according to claim 1, wherein at the one end portion of the air passage, a first communication port is provided which allows communication between the air passage and the inner space of the cap portion, at the other end portion of the air passage, a second communication port is provided in a bottom surface of the groove portion, and at such part of the support member as corresponds to the second communication port, a third communication port is provided which allows communication between the air passage and the outside of the cap portion via the second communication port.

3. The cap member according to claim 2, wherein the first communication port is provided in the lid member.

4. The cap member according to claim 3, wherein a periphery of the first communication port projects upward from an upper surface of the lid member.

5. The cap member according to claim 1, wherein the air passage includes a plurality of air passages.

6. The cap member according to claim 5, wherein the groove portion includes a plurality of groove portions, and the plurality of groove portions and the lid member define the plurality of air passages.

7. The cap member according to claim 1, wherein the bottom surface portion of the cap portion is provided with a second rib which projects from the upper surface of the bottom surface portion by an amount equal to an amount by which the first rib projects from the upper surface of the bottom surface portion, the lid member being disposed on the second rib in close contact with an upper end of the second rib.

8. The cap member according to claim 7, wherein the first rib includes a plurality of first ribs, and the second rib includes a plurality of second ribs, the plurality of first ribs are provided, along an edge portion of the lid member, at positions point-symmetric to each other with respect to a center of the cap portion, and the plurality of second ribs are provided, along such part of the edge portion of the lid member as is provided with none of the plurality of first ribs, at positions point-symmetric to each other with respect to the center of the cap portion.

9. The cap member according to claim 1, wherein the groove portion is so formed as to extend in a predetermined direction, the lid member is pressed against the first rib by a plurality of pressing members disposed at predetermined intervals in the predetermined direction, and a convex portion which is mountain-shaped is provided at such part of an inner surface of the groove portion as faces an intermediate portion between adjacent ones of the pressing members.

10. The cap member according to claim 9, wherein the convex portion is formed such that a projection amount thereof gradually increases from a position adjacent to such part of the groove portion as faces any one of the pressing members toward such part of the groove portion as faces an intermediate portion between adjacent ones of the pressing members.

11. The cap member according to claim 9, wherein the convex portion is provided on a bottom surface of the groove portion.

12. The cap member according to claim 9, wherein the convex portion is provided on a side surface of the first rib which defines the groove portion.

13. An inkjet recording apparatus comprising:

the cap member according to claim 1; and the recording head which ejects ink onto a recording medium.

14. An inkjet recording apparatus comprising:

the cap member according to claim 3; and the recording head which ejects ink onto a recording medium, wherein the first communication port is provided at a retracted position retracted from a position directly below the ink ejection port of the recording head with the cap portion capping the recording head.

* * * * *